United States Patent [19]

Chiu et al.

[11] Patent Number: 4,604,871

[45] Date of Patent: Aug. 12, 1986

[54] OVER-TEMPERATURE WARNING SYSTEM FOR REFRIGERATOR APPLIANCE

[75] Inventors: Norman H. Chiu; David A. Schneider, both of Louisville, Ky.

[73] Assignee: General Electric Company, Louisville, Ky.

[21] Appl. No.: 692,081

[22] Filed: Jan. 17, 1985

[51] Int. Cl.[4] ..... G08B 17/00

[52] U.S. Cl. ..... 62/130; 340/588

[58] Field of Search ..... 62/130, 127, 125, 126, 62/129; 236/94; 165/11 R; 340/585, 588

[56] References Cited

U.S. PATENT DOCUMENTS

| | | | |
|---|---|---|---|
| 2,526,679 | 10/1950 | McCary | 200/140 |
| 3,136,137 | 6/1964 | Crossley | 62/130 |
| 3,277,458 | 10/1966 | Greenwood | 340/227 |
| 3,343,151 | 9/1967 | Brown et al. | 340/227 |
| 3,707,851 | 1/1973 | McAshan, Jr. | 62/125 |
| 4,240,077 | 12/1980 | Hughes et al. | 340/500 |
| 4,283,921 | 8/1981 | Prosky | 62/126 |
| 4,315,296 | 2/1982 | Hancock | 340/588 X |
| 4,387,578 | 6/1983 | Paddock | 236/94 X |
| 4,407,141 | 10/1983 | Paddock | 62/130 |

OTHER PUBLICATIONS

Althouse et al., *Modern Refrigeration and Air Conditioning,* The Goodheart-Willcox Company, Inc. South Holland, Ill., p. 480, (1979).

*Primary Examiner*—Harry B. Tanner

*Attorney, Agent, or Firm*—H. Neil Houser; Radford M. Reams

[57] ABSTRACT

An improved over-temperature warning system for a refrigerator/freezer appliance comprises a temperature sensor responsive to the temperature in the freezer compartment of the appliance and logic circuitry responsive to the sensor operative to detect a first over-temperature condition when the sensed temperature is greater than a first reference temperature and less than a second reference temperature and to detect a second over-temperature condition when the sensed temperature is greater than the second reference temperature. The logic circuitry times the duration of the first and second over-temperature conditions and provides a user discernible warning signal when the first condition exceeds a first predetermined time period or when the second over-temperature condition exceeds a second predetermined time period shorter than the first time period.

11 Claims, 19 Drawing Figures

IM CHECK

342
IS IM FLAG SET ?
NO
YES
344
IS PREV/ON SET
YES
NO
348
SET PREV/ON
350
RESET IM TOGGLE
352
RESET CI TIMER→5 HRS.
346
IS CI TIMER=0 ?
YES
NO
354
IS IM COUNT > 3 ?
NO
YES
348
SET CI FAULT FLAG
356
IS PREV/ON SET
NO
YES
360
RESET PREV/ON
362
RESET CI TIMER TO 10 MIN.
358
IS CI TIMER ZERO ?
YES
NO
364
RESET IM COUNT
366
IS IM TOGGLE SET ?
YES
NO
368
SET IM TOGGLE
370
INCREMENT IM COUNT
BRANCH TO PRIORITIZE
372

OVER-TEMPERATURE WARNING SYSTEM FOR REFRIGERATOR APPLIANCE

BACKGROUND OF THE INVENTION

The present invention relates to an improved over-temperature alarm system for an appliance having a freezer compartment for storing perishable items.

With appliances such as refrigerators and freezers it is desirable to provide a warning indication to the user when the temperature conditions in the freezer present a risk of damage to perishable items stored therein.

Implementation of an over-temperature warning system in such appliances is complicated by the fact that during normal use the freezer compartment door is opened frequently for the insertion and removal of items. When the freezer door is opened the temperature of the air within the freezer increases rapidly toward the ambient room temperature. However, since the temperature of the items refrigerated in the compartment changes relatively slowly, such items are not adversely affected by such occasional increases in air temperature within the freezer unless such conditions exist for a sufficient time to allow the temperature of the items themselves to rise to unacceptably high temperatures. Normally once the door is closed the temperature within the freezer returns to within its normal operating limits quickly enough to prevent any damage to the refrigerated items. This recovery time varies greatly, however, and is a function of a number of factors including how long the door was open, the ambient room temperature, the number of refrigerated items present in the freezer when the door was opened and the temperature and quantity of items being added to the freezer. A second cause of temporary over-temperature conditions in freezers of the so-called frost free type is the automatic defrost cycle. During this cycle the heat generated by the defrost heater to melt frost from the evaporator coils raises the air temperature in the freezer above its normal operating limits. A satisfactory warning system must have sufficient sensitivity to alert the user to over-temperature conditions resulting from abnormal system operation quickly enough to enable the user to take precautions before damage to the refrigerated items occurs while at the same time avoiding nuisance alarms resulting from temporary over-temperature conditions which are likely to occur during normal operation.

In U.S. Pat. No. 4,407,141 Paddock recognizes this problem, noting that in conventional refrigeration apparatus in which the temperature sensor is responsive to the temperature in the fresh food compartment it is desirable to set the trip point at the relatively high temperature of 60° F. even though normal operating temperature is below 32° F. in order to avoid nuisance alarms. Paddock suggests that the system may be made more sensitive by employing a second sensor responsive to the room temperature which is used in combination with the internal fresh food temperature sensor to vary the trip point as a function of the room ambient temperature, allowing the trip point to be set closer to the normal temperature range for lower room temperatures.

U.S. Pat. No. 4,387,578-Paddock discloses an over-temperature alarm system for a refrigerator appliance in which the single 60° F. set point is employed in combination with a timer which monitors the duration of the over-temperature condition and provides a visual warning signal only after the over-temperature condition has continued for a predetermined time such as 1½ hours. The visual signal changes from a steady signal to a flashing signal when the temperature drops below the threshold and continues to flash until switched off by the user to alert the user that an over-temperature condition has occurred. In addition, if the condition persists for 10 hours an alert symbol is energized, warning the user that the abnormal condition has existed for a relatively long time.

Both of the Paddock approaches utilize a single set point greater than the desired operating range. Consequently, there is a range between the set point and the desired operating range within which the air temperature in the freezer may stabilize or increase so slowly that the refrigerated items become damaged before the set point is reached.

Another approach to the problem is disclosed in U.S. Pat. No. 3,343,151 to Brown et al, which teaches the use of a temperature sensitive device having substantially the same time-temperature constant as the product or article being refrigerated. When disposed in the same environment as these articles, the internal temperature of the device may be taken as being the same as the articles. The temperature control system including an over-temperature alarm then responds to the temperature of the device which closely tracks the refrigerated articles. This approach may be useful when refrigerating articles of fairly uniform size and temperature constant characteristics. In view of the wide variety of items typically stored in a home refrigerator/freezer, a representative simulation device would be extremely difficult to design, and would add significantly to the materials and manufacturing costs. In addition, in such appliances storage space is at a premium and the simulation device would take up considerably more space within the freezer than does a simple thermistor type sensor.

In view of the shortcomings of these known approaches, it is desirable to provide an over-temperature warning system for a refrigerator/freezer appliance of sufficient sensitivity to reliably detect and alert the user to over-temperature conditions in the freezer resulting from abnormal system operation in timely fashion so as to enable the user to take appropriate preventive action to protect the refrigerated items from damage yet which does not respond to temporary over-temperature conditions such as typically result from the normal opening and closing of the freezer door and from automatic defrost cycles.

It is therefore an object of the present invention to provide an over-temperature warning system which alerts the user to an over-temperature condition when the sensed temperature exceeds a first relatively low reference temperature for a relatively long time or exceeds a second relatively high reference temperature for a relatively short time, thereby avoiding nuisance trips while alerting the user to abnormal conditions before damage to the refrigerated items has occurred.

It is a further object of the present invention to provide an over-temperature warning system of the aforementioned type which also generates a warning signal that either the lower reference temperature or the higher reference temperature has been exceeded for respective time periods of sufficient duration that damage could have already occurred and which signal continues pending user intervention even though the sensed temperature may have subsequently returned to within its normal operating range.

SUMMARY OF THE INVENTION

In accordance with the present invention an improved over-temperature warning system for a refrigerator/freezer appliance comprises a temperature sensor responsive to the temperature in the freezer compartment of the appliance and logic circuitry responsive to the sensor operative to detect a first over-temperature condition when the sensed temperature is greater than a first reference temperature and less than a second reference temperature and to detect a second over-temperature condition when the sensed temperature is greater than the second reference temperature. The logic circuitry is further operative to time the duration of the first and second over-temperature conditions and provide a user discernible warning signal when the first condition exceeds a first predetermined time period or when the second over-temperature condition exceeds a second predetermined time period shorter than the first time period. By this arrangement the system retains the sensitivity to respond to over-temperature conditions relatively close to the desired operating temperature provided such temperature conditions persist longer than the recovery time associated with normal operation and usage of the appliance thereby avoiding nuisance warnings. In addition, the system responds relatively quickly to relatively extreme over-temperature conditions so as to avoid damage to perishable items.

In accordance with another aspect of the invention, the aforementioned warning signal terminates when the sensed temperature drops below the first reference temperature. However, the logic circuitry is operative to provide an alert signal which continues until user intervention occurs, if the first or second over-temperature conditions continue for time periods greater than third or fourth time periods respectively. These latter time periods are selected such that the existence of either of these over-temperature conditions for greater than its associated reference period may have already caused the refrigerated items to have been adversely affected. By this arrangement the user is alerted to the occurrence of an over-temperature condition which may have resulted in damage to the refrigerated items even though the sensed temperature may have subsequently returned to its normal operating range.

BRIEF DESCRIPTION OF THE DRAWINGS

While the novel features of the invention are set forth with particularity in the appended claims, the invention, both as to organization and content, will be better understood and appreciated, along with other objects and features thereof, from the following detailed description taken in conjunction with the drawings, in which:

DETAILED DESCRIPTION

Figure 1:
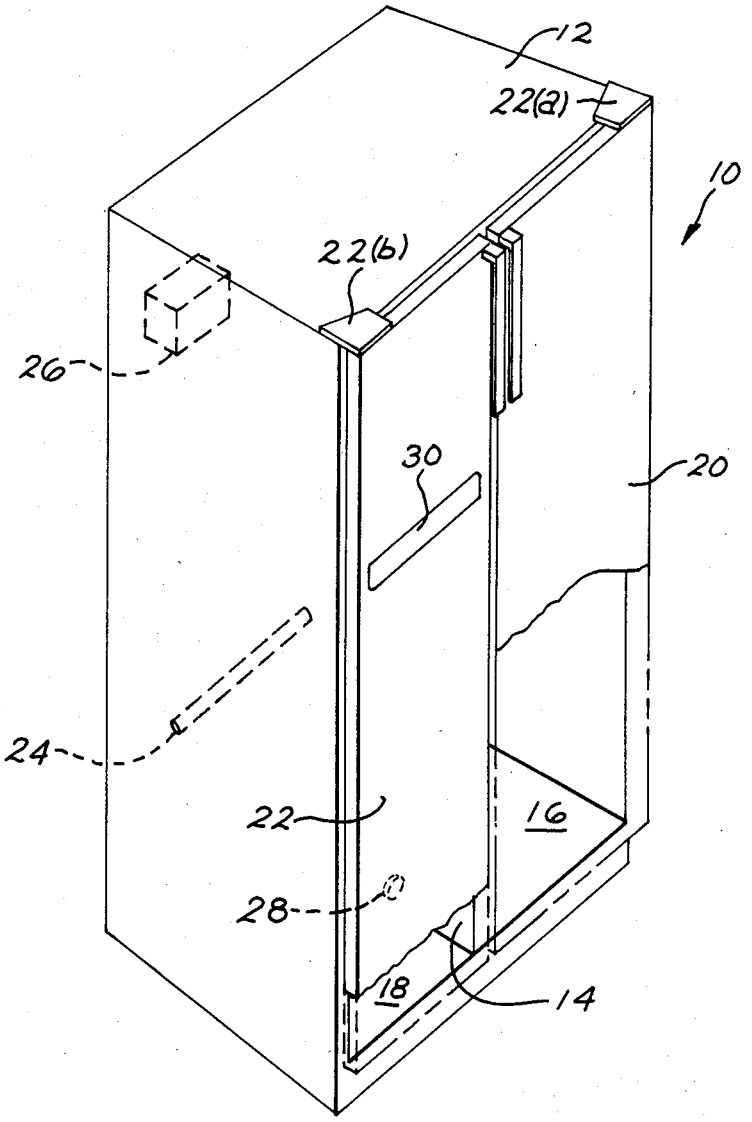
FIG. 1 is a perspective view of a two door side-by-side refrigerator/freezer with portions of the doors broken away to show the interior of the fresh food and freezer compartments and showing in schematic fashion the temperature sensor, defrost heater and icemaker located in the freezer compartment.

Referring now to FIG. 1 there is shown a side-by-side refrigerator/freezer 10 including a cabinet 12 having a divider wall 14 separating the interior of the cabinet into a fresh food compartment 16 and a freezer compartment 18. Fresh food compartment 16 is enclosed by fresh food door 20 conventionally hinged on the right side by hinges 22(*a*) and freezer compartment 18 is enclosed by freezer door 22 conventionally hinged on the left side by hinges 22(*b*). Enclosed within the freezer compartment is a conventional defrost heater shown schematically at 24 which is mounted to and runs horizontally across the rear wall of freezer compartment 18 approximately mid-way between the top and bottom of the compartment and an automatic icemaker shown schematically at 26 located in the upper rear portion of the freezer compartment. A temperature sensor for monitoring the temperature within the freezer compartment is shown schematically at 28 mounted to the interior face of freezer door 22.

Refrigerator/freezer 10 is provided with a diagnostic sensing and display system which monitors the operation of various appliance operating conditions and provides diagnostic signals to the user, informing the user of certain abnormal operating conditions. In accordance with the present invention the diagnostic sensing and display system monitors the temperature in the frozen food compartment to alert the user to the existence of undesirable over-temperature conditions in the freezer. More specifically, a first signal is provided indicating that a warm temperature condition exists in the freezer which if left unattended could result in damage to the refrigerated items. In the event this condition exists for a prolonged period of time sufficient to adversely affect perishable items being refrigerated, a second signal is provided to inform the user that such damage may have already occurred. In addition to monitoring the temperature condition in the freezer, the sensing and display system also monitors the defrost heater circuit and the icemaker control circuit and provides the appropriate diagnostic code to alert the user to a malfunction of either of these components. The defrost and icemaker monitoring arrangements are described and claimed in co-pending commonly assigned U.S. patent application Ser. No. 692,099, filed Jan. 17, 1985 and Ser. No. 692,075, filed Jan. 17, 1985 respectively, which are hereby incorporated by reference.

Figure 2:
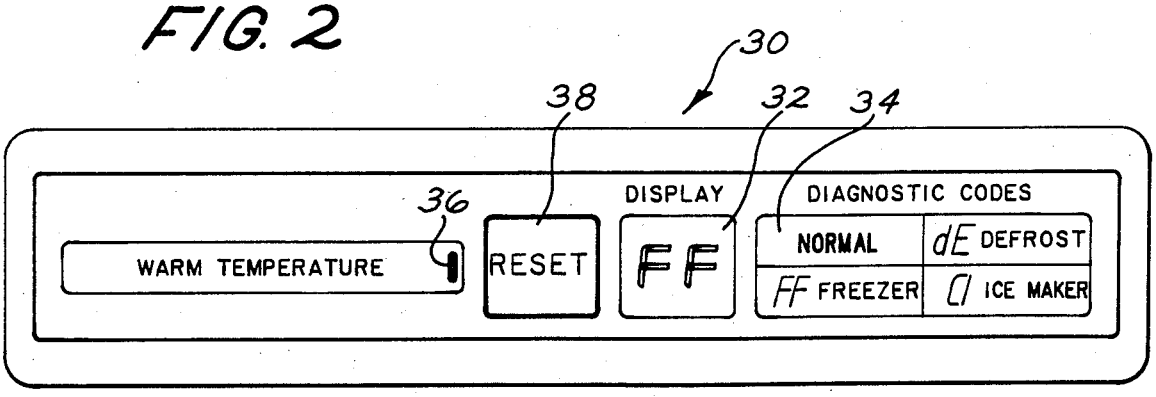
FIG. 2 is an enlarged view of the control and display panel mounted on the freezer door in the refrigerator of FIG. 1.

A control and display panel 30 for the diagnostic sensing and display system is provided on the outer face of freezer door 22. As best seen in FIG. 2 control panel 30 includes a two-digit LED display 32, a back-lit '37 normal" display indicator 34, a Warm Temperature indicator light 36, and a manually actuable reset key 38. As defined on the control panel adjacent display 32, the diagnostic codes FF, DE and CI are employed to indicate abnormal operating conditions having been detected for the freezer, the defrost heater circuit and the icemaker circuitry respectively. The FF shown in display 32 for illustrative purposes signifies that an over-temperature condition has been detected in the freezer which has continued for a sufficient time to have possibly adversely affected the condition of items stored in the freezer.

Figure 3:
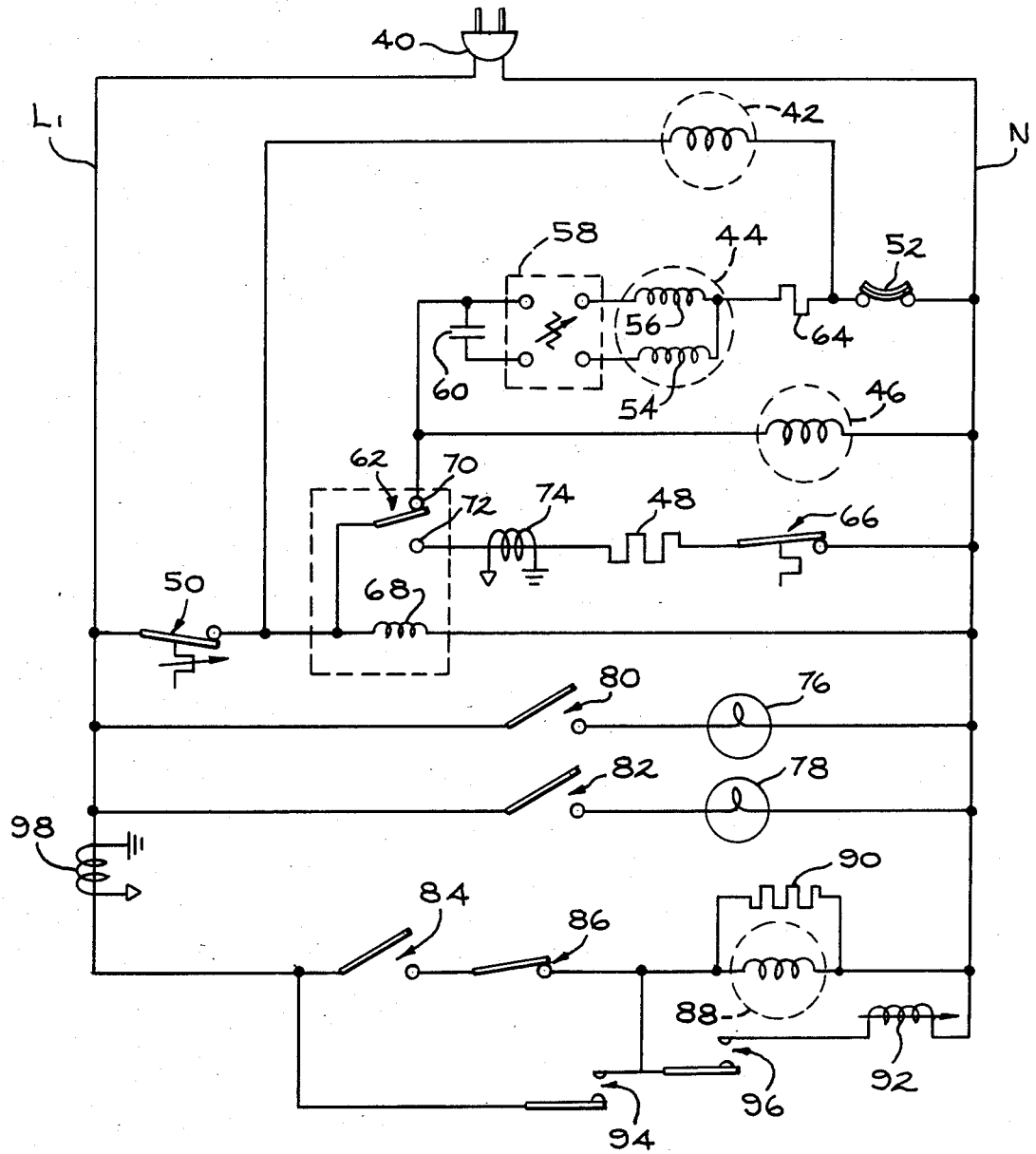
FIG. 3 is a simplified schematic diagram of the main power circuit for the refrigerator of FIG. 1.

The main power circuit for refrigerator/freezer 10, which includes the compressor motor 44, the condenser fan motor 42, the evaporator fan motor 46, the defrost heater 48 and the icemaker circuitry comprising essentially a motor 88, mold heater 90 and fill valve solenoid 92, is illustrated schematically in FIG. 3. Power is applied to the circuit via lines L1 and N which are adapted for connection to a standard 60 Hz 120 volt AC domestic power receptacle by plug 40. Condenser fan motor 42 is connected between L1 and N in series with thermostat switch 50 and thermal cut-out switch 52. The compressor motor circuit, comprising motor start winding 54 and run winding 56, a positive temperature coefficient relay switch 58 and run capacitor 60 is connected to L1 through defrost timer controlled switch 62 and temperature control thermostat switch 50. The other side of the compressor motor circuit is connected to N through an over-current protection fuse 64 and thermal cut-out switch 52. One side of the evaporator fan motor 46 is connected to L1 through defrost timer switch 62 and thermostat 50, with the other side connected directly to N. Defrost timer switch 62 is normally closed across compressor circuit contact 70 as shown, except during defrost cycles as will be hereinafter described. Thus, energization of the compressor circuit is controlled by temperature control thermostat 50.

Defrost heater 48 is connected to L1 through defrost timer switch 62 and thermostat 50 and to N through defrost thermostat switch 66. Defrost timer motor winding 68 is connected between L1 and N in series with temperature control thermostat switch 50. Defrost timer switch 62 is actuated by a cam (not shown) driven by the defrost timer motor to initiate and terminate the defrost cycle. The cam is adapted to close switch 62 across defrost heater contact 72 to initiate defrost after approximately twelve hours of timer motor run time and to maintain the switch in this position for approximately 30 minutes of motor run time before reclosing the switch across compressor circuit contact 70. It will be appreciated that since the timer motor is only energized when the temperature control thermostat switch 50 is closed, the time between defrost cycles depends upon how long and how frequently the compressor is energized which depends upon a number of factors including the temperature setting, how often the doors are opened, the room temperature. Consequently, the time between defrosts can, under normal operating conditions, be as long as 40–48 hours. As mentioned the timer switch 62 remains in the defrost position for approximately 30 minutes of timer motor run time. However, the heater remains energized only until the defrost thermostat 66 opens which normally occurs before switch 62 opens. The defrost thermostat senses the temperature of the evaporator coils (not shown) which temperature rises rapidly when the frost is removed.

A current sensor in the form of a current transformer winding 74, used in the sensing circuitry to be hereinafter described, is positioned to detect current flow in the defrost heater circuit.

A freezer compartment light 76 and a fresh food compartment light 78 for illuminating the interior of the refrigerator are connected in parallel across L1 and N. Energization of these lights is controlled by door actuated switches 80 and 82 respectively which are closed when the respective compartment doors are opened and vice versa.

The icemaker circuit, connected across L1 and N, comprises feeler arm switch 84, mold thermostat switch 86, icemaker motor 88, mold heater 90, water valve solenoid 92 and icemaker motor controlled, cam-actuated switches 94 and 96. One side of icemaker motor 88 is connected to L1 through mold thermostat switch 86 and feeler arm switch 84. Mold heater 90 is connected in parallel with motor 88. Cam actuated switch 94 controlled by motor 88 is operative when closed to shunt feeler arm switch 84 and mold thermostat 86. Icemaker water valve solenoid 92 and serially connected cam actuated switch 96 are connected in parallel with motor 88. Structural details of a suitable icemaker apparatus is described in U.S. Pat. Nos. 3,163,017 to Baker et al and 3,163,018 to Shaw which are hereby incorporated by reference.

The icemaker cycle is divided into five phases: freeze; release; eject; sweep and water fill. Normally, feeler arm switch 84 is closed at the beginning of the cycle and the cube forming mold (not shown) is filled with water. Thermostat switch 86 is positioned to sense when the water in the mold has frozen. When the water is frozen, switch 86 closes, energizing motor 88 and mold heater 90. Motor 88 moves an ejection lever (not shown) to eject the newly formed cubes from the mold. Typically, motor 88 stalls after a brief rotation until the mold heater has warmed the mold sufficiently to release the cubes; however, the initial movement of the motor prior to stalling rotates a cam (not shown) sufficiently to close switch 94 which shunts thermostat 86 to maintain motor energization.

Following ejection of the cubes, cam switch 96 is closed to energize the valve solenoid 92. After a timed fill period controlled by motor 88 switch 96 opens. Since thermostat switch 86 is now open, the cycle ends when cam actuated switch 94 opens de-energizing motor 88. A current sensor comprising current transformer winding 98, also used in the sensing circuitry to be hereinfter described, is positioned to sense current flow in the icemaker circuitry.

Figure 4:
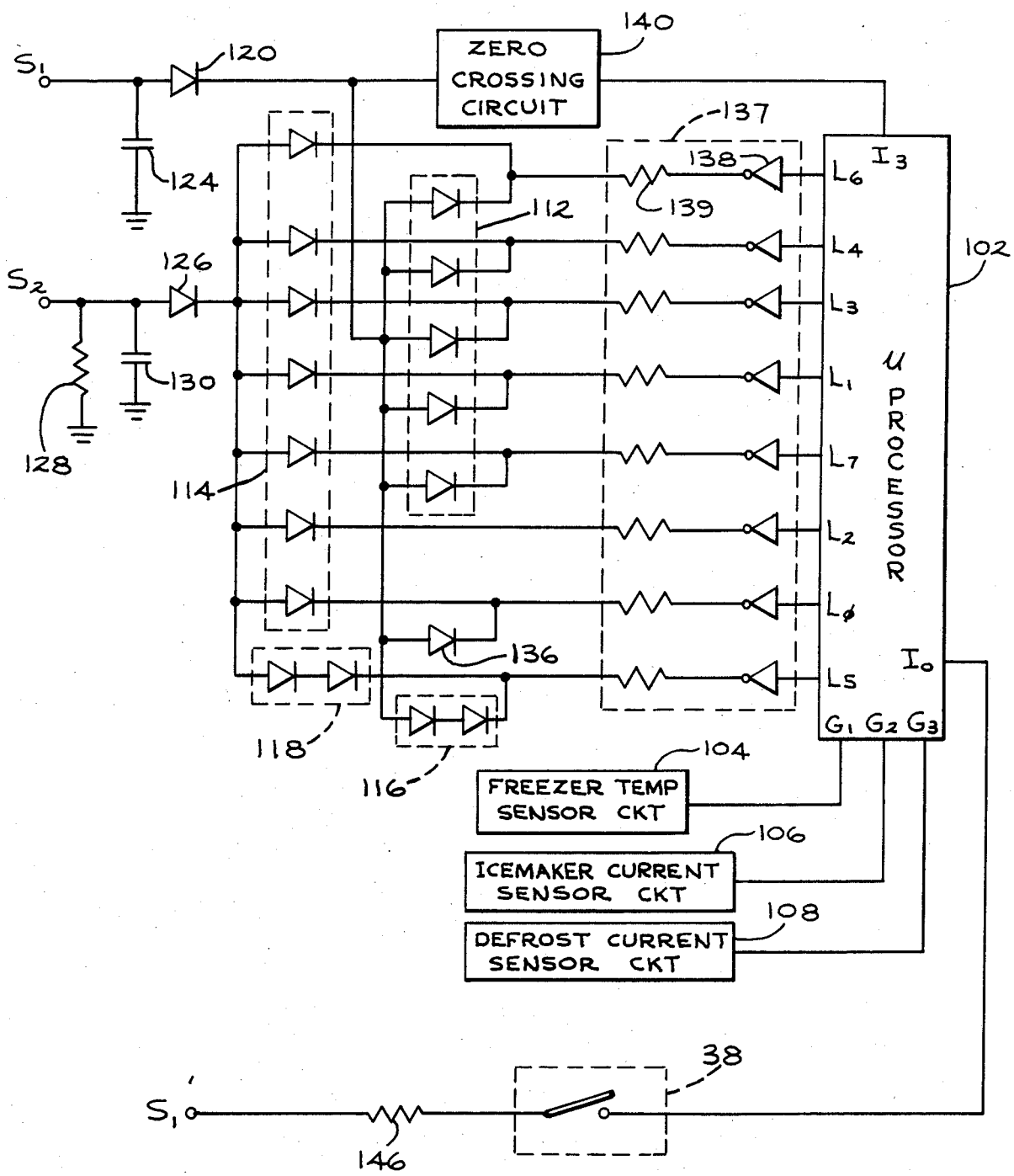
FIG. 4 is a simplified schematic diagram of the electronic sensing and display circuit for the refrigerator of FIG. 1.

The sensing and display system circuitry for refrigerator/freezer 10 which illustratively embodies the over-temperature alarm system of the present invention is shown schematically in FIG. 4. The primary control component in the circuit is microprocessor 102 which receives input signals from freezer temperature circuit 104, icemaker current sensing circuit 106, and defrost current sensing circuit 108; processes these inputs in accordance with a control program to be hereinafter described; and generates output signals for controlling the control panel display means comprising warm temperature LED 36, the NORMAL indicator 34 and the two-digit diagnostic code display 32 (FIG. 2).

It will be recalled that a primary object of the over-temperature alarm system of the present invention is to provide a reliable alarm system which is sensitive to over-temperature conditions just slightly above freezing and yet which avoids nuisance trips occasioned by temporary over-temperature conditions typical of normal freezer operation. To this end, advantageous use is made of the fact that perishable items of the type normally stored in domestic freezer compartments can safely tolerate temperatures at or slightly above freezing (32° F.) for much longer time periods than temperatures significantly higher can be tolerated.

In accordance with the present invention two reference temperatures are employed, one relatively close to freezing to detect over-temperature conditions at or slightly above freezing in the freezer and the other substantially above freezing. A relatively long delay time is associated with the low reference temperature to avoid nuisance trips and a relatively short delay time is associated with the higher reference temperature to enable a timely system response to relatively high over-temperature conditions in the freezer. Of course, the sensed freezer temperature will frequently exceed the low reference temperature due to normal opening of the freezer door for loading and unloading purposes, as well as during defrost cycles. The upper reference temperature may also be exceeded on occasion during normal operation. Ordinarily, when the system is operating properly, the recovery time, that is the time required for the sensed temperature to drop below the lower reference temperature, is short enough that the refrigerated items are unaffected. As mentioned in the Background, the recovery time is subject to considerable variation under the influence of a number of factors. However, it is possible to empirically determine a time period which is long enough to exceed the recovery time for at least most normal temporary over-temperature conditions thereby avoiding nuisance trips yet which is short enough to alert the user to the undesirable condition before the refrigerated items are damaged.

It has been empirically determined that items of the type normally stored in a domestic freezer, when well-frozen, can withstand ambient temperatures in the 30°-50° F. range for up to 5-6 hours without significant adverse affects. In addition, it was empirically determined that for the 24 $ft^3$ side-by-side domestic refrigerator/freezer of the type manufactured by General Electric Company the recovery time for at least most normal temporary over-temperature conditions in the freezer is less than four hours. Similarly, it has been determined that frozen items can tolerate temperatures between 50° F. and normal room temperatures 70°-80° F. for at least 1-2 hours without serious adverse affect. For those normally occurring temporary over-temperature conditions characterized by ambient temperature greater than 50° F., the time required for the effective ambient freezer temperature to drop below 50° F. is less than 1 hour. It will be appreciated that the delay times should be determined empirically for each particular freezer configuration, as the recovery times may vary as a function of such factors as the insulating characteristics, the size of the freezer compartment, and the efficiency of the cooling system.

Due primarily to the mounting of the temperature sensor in a housing on the freezer door, a temperature differential on the order of +5° F. has been observed between the temperature in the immediate vicinity of temperature sensor and the ambient temperature in the central region of freezer compartment for this model. The former will be hereinafter referred to as the sensed freezer temperature and the latter will be referred to as the effective ambient freezer temperature. Hence, the sensed freezer temperature will be roughly 5° F. higher than the effective ambient freezer temperature. Thus, the reference temperatures employed for detecting malfunctions are set at 5° F. higher than the desired effective ambient freezer temperature limits.

As will be hereinafter described in greater detail the sensing and display system is operative to provide a Warm Temperature signal to the user upon detection of either a first over-temperature condition (defined by a sensed freezer temperature in the 35°-55° F. temperature range) which has continued for at least 4 hours, or detection of a second over-temperature condition (defined by a sensed freezer temperature greater than 50° F.) which has continued for at least one hour. This signal terminates when the sensed temperature drops below 35° F. The primary purpose of this signal is to alert the user to an undesirable temperature condition in the freezer which has not yet, but, if allowed to continue, could damage refrigerated items.

Of course, should either of these over-temperature conditions continue long enough, refrigerated items may be damaged. Consequently, a second signal is provided to the user in the form of a flashing "FF" display if the first over-temperature condition continues for at least 6 hours or the second over-temperature condition continues for at least 2 hours. This signal continues until terminated by user actuation of the Reset Key 38 (FIG. 2). The 6 hour and 2 hour time limits have been conservatively selected and are believed to be somewhat less than the maximum times effective ambient freezer temperatures in the 30°-50° F. and 50°-80° F. ranges respectively can be tolerated by the normal assortment of frozen items stored in domestic freezers without damage.

Temperature sensing circuit 104 senses the temperature in the freezer compartment of refrigerator 10. As will be described in greater detail with reference to the program flow diagrams of FIGS. 8-16, microprocessor 102 is internally configured to include means responsive to the temperature sensor circuit and operative to detect a first temperature condition when the sensed temperature in the freezer is greater than a first relatively low reference temperature preferably on the order of 35° F. and less than a second relatively high reference temperature preferably on the order of 55° F. (corresponding to an effective ambient freezer temperature in the 30°-50° F. range) and to detect a second temperature condition when the sensed temperature in the freezer is greater than the second reference temperature (corresponding to an effective ambient freezer temperature greater than 50° F.). Microprocessor 102 further includes timer means operative to time the duration of the first and second operating conditions, and means responsive to the timer means operative to generate a first set of output signals indicative of an undesirable time/-temperature condition in the freezer compartment whenever the duration of the first temperature condition exceeds a first relatively long delay time preferably on the order of four hours or the duration of the second temperature condition exceeds a second relatively short delay time preferably on the order of one hour.

Microprocessor 102 is further operative to generate additional output signals signifying an over-temperature condition of sufficient duration to have possibly damaged refrigerated items whenever the first over-temperature condition exceeds a third delay time preferably on the order of six hours or the duration of the second over-temperature condition exceeds a fourth delay time greater than the first relatively short delay time preferably on the order of two hours.

Display means responsive to the microprocessor output signals provides a first user discernible warning signal in response to the first set of output signals and provides a second user discernible signal in response to the second set of output signals. In the illustrative embodiment, first user discernible signal is provided by energizing the Warm Temperature LED 36 (FIG. 2) and the second user discernible signal is provided by displaying the FF diagnostic code in display 32 (FIG. 2). The first signal remains until the sensed temperature drops below the first reference temperature. However, the second signal remains until reset by reset means including reset key 38 (FIG. 2) regardless of whether the sensed temperature subsequently drops below the 35° F. reference temperature.

The display means for the sensing and display circuitry in FIG. 4 comprises a five segment parallel LED array 112 which comprises the right hand digit in display 32 (FIG. 2); a seven-segment LED array 114 which comprises the left-hand digit in display 32; two two-segment LED arrays 116 and 118 which provide backlighting for Normal indicia 34; and LED 36 which comprises the Warm Temperature indicator (FIG. 2). The arrays are energized by low voltage half-wave rectified AC signals applied to terminals $S_1$ and $S_2$. $S_1$ is coupled to the anode terminal of each of the LED segments in array 112 via isolating diode 120. Array 112 is enabled when the signal at $S_1$ is positive. Bypass capacitor 124 is connected between $S_1$ and ground. $S_2$ is similarly coupled to the anode of each LED segment in seven segment parallel array 114 via isolating diode 126. $S_2$ is effective to enable array 114 when the signal at $S_2$ is positive. Resistor 128 and bypass capacitor 130 are connected between $S_2$ and ground. Resistor 128 is provided to balance loads so that waveforms at $S_1$ and $S_2$ are symmetric.

Figure 5A:
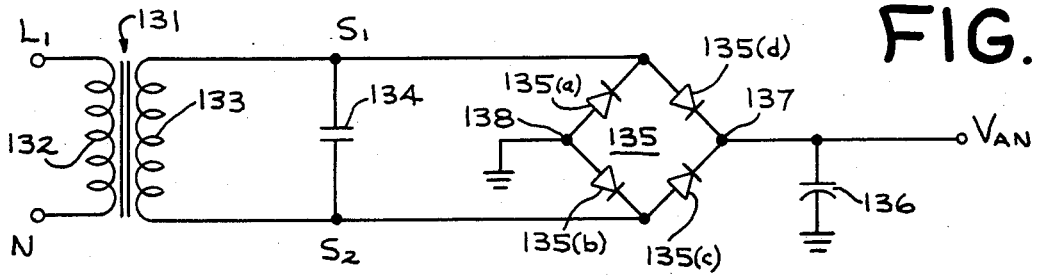
FIGS. 5A and 5B are schematic circuit diagrams for the low voltage power supply for the circuits of FIG. 4.
Figure 6:
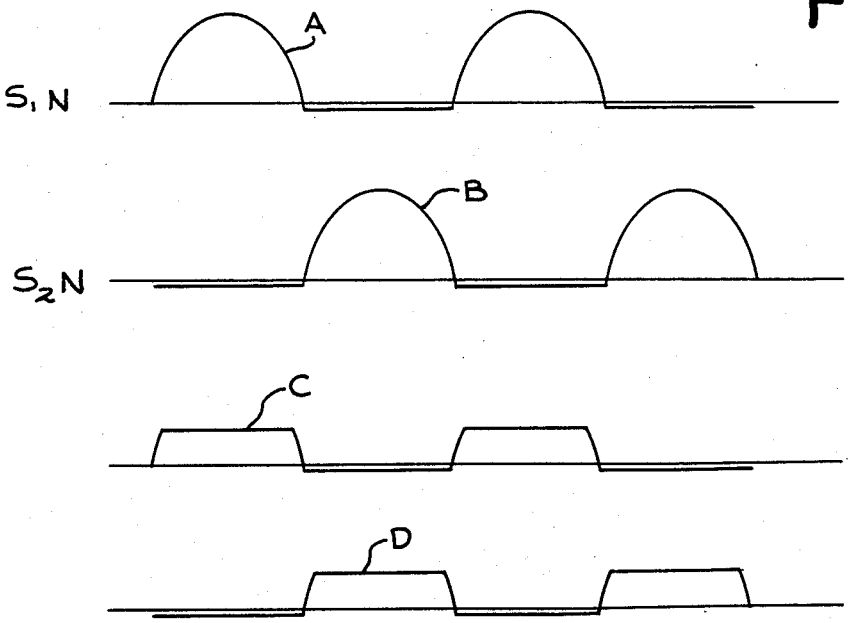
FIG. 6 is a graphical representation of the low voltage power signals from the power supply of FIG. 6.

The signals applied at $S_1$ and $S_2$ are derived from the dc power supply circuitry illustrated in simplified schematic form in FIG. 5A. A step down transformer 131 has its primary winding 132 connected across $L_1$ and N. The terminals of secondary winding 133 are designated $S_1$ and $S_2$. The stepped down voltage is converted to a dc signal $V_{AN}$ via bypass high frequency capacitor 134 connected across $S_1$ and $S_2$ in parallel with full-wave rectifying diode bridge 135 comprising diodes 135(*a*), 135(*b*), 135(*c*) and 135(*d*). Electrolytic filter capacitor 136 is coupled between bridge output terminal 137 and ground. The other bridge output terminal 138 is connected directly to ground. Waveforms A and B of FIG. 6 represent the voltage between $S_1$ and ground (N) and $S_2$ and ground (N) respectively. Diode 135(*a*) limits the negative swing of the voltage at $S_1$ to one diode drop (0.6 volts) negative with respect to ground. Similarly, diode 135(*b*) limits the negative swing of the voltage at $S_2$ to one diode drop negative with respect to ground. The voltage signal between $S_1$ and ground is 180° out of phase with the voltage across $S_2$ and ground resulting in display arrays 112 and 114 being enabled during alternate half-cycles of the 60 Hz power signal across L1 and N. The two segment serial LED arrays 116 and 118 are similarly coupled to $S_1$ and $S_2$ respectively and alternately enabled.

Referring again to FIG. 4, microprocessor output ports $L_0$–$L_7$ provide output signals for controlling the LED arrays. These signals are coupled to the cathode terminals of the LEDs in each array by driver circuitry 137. Driver circuitry 137 comprises an open collector driver 138 and a current limiting resistor 139 for each of microprocessor output ports $L_0$–$L_7$. Each output port is coupled to the input terminal of its associated open collector driver. The collector terminal of each driver is coupled by serially connected current limiting resistor 139 to the cathode terminal of its associated LED segments. Each of output ports $L_1$, $L_3$, $L_4$, $L_6$, and $L_7$ is coupled to two associated LED segments, one in each of arrays 112 and 114. $L_2$ is coupled only to an associated LED in array 114. $L_0$ is coupled to an LED segment in array 114 and to the Warm Temperature LED 36. LED 36 has its anode connected to $S_1$ via isolating diode 120. $L_5$ is coupled to LED arrays 116 and 118.

Zero crossing detector circuit 140 monitors the signal at $S_1$ and provides a logic high or one signal at microprocessor input port $I_3$ when the voltage at $S_1$ is positive with respect to ground and a logic low or zero signal at $I_3$ when the voltage at $S_1$ is negative with respect to ground, to synchronize the processing of input and output signals.

The appropriate LED segments are energized by providing a logic high output signal at the appropriate ones of output ports $L_0$–$L_7$. This provides a current path to ground through the collector terminal of the associated open collector driver devices. The microprocessor outputs the correct code for the LED segments coupled to $S_1$ during the positive half-cycles of the signal at $S_1$ and the correct code for the LED segments coupled to $S_2$ during the positive half-cycles of the signal at $S_2$. The state of the input at $I_3$ signifies to the microprocessor which half-cycle is in progress at any point in time.

This unique duplexing arrangement for controlling the display provides the advantages of a conventional multiplex arrangement using fewer discrete resistors and transistors and fewer microprocessor I/O lines and also reduced the loading requirements for the filtered power supply. This arrangement is the subject of commonly assigned co-pending U.S. patent application Ser. No. 692,085, filed Jan. 17, 1985.

In addition to the power signal phase indicating signal received at input port $I_3$ from zero crossing circuit 140, microprocessor 102 also receives input signals from sensors monitoring various refrigeration system operating parameters and user inputs. Specifically, input signals from freezer temperature sensor circuit 104, icemaker current sensor circuit 106 and defrost current sensor circuit 108 are coupled to input ports G1, G2 and G3 respectively. Sensor circuits 104–108 are shown in greater detail in FIGS. 7A–7C respectively yet to be described.

The status of the user actuable reset key 38 (FIG. 2) is signified by the signal coupled to input port $I_0$. Reset key 38 comprises a normally open tactile membrane switch, serially connected to current limiting resistor 146. Resistor 146 and switch 38 are connected between input port $I_0$ and $S_1$. User actuation of switch 38 is signified by a logic high signal applied to input port $I_0$ when the voltage at $S_1$ is positive with respect to ground.

Figure 7A:
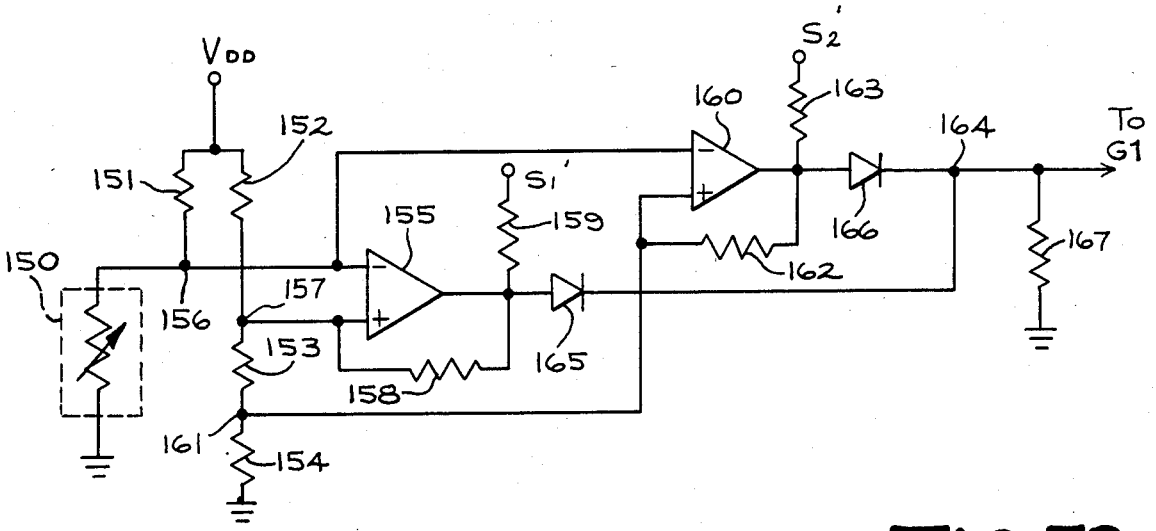
FIGS. 7A, 7B and 7C are detailed schematic diagrams of the temperature sensor circuit, icemaker current sensor circuit and defrost current sensor circuit portions respectively of the circuit of FIG. 4.
Figure 7B:
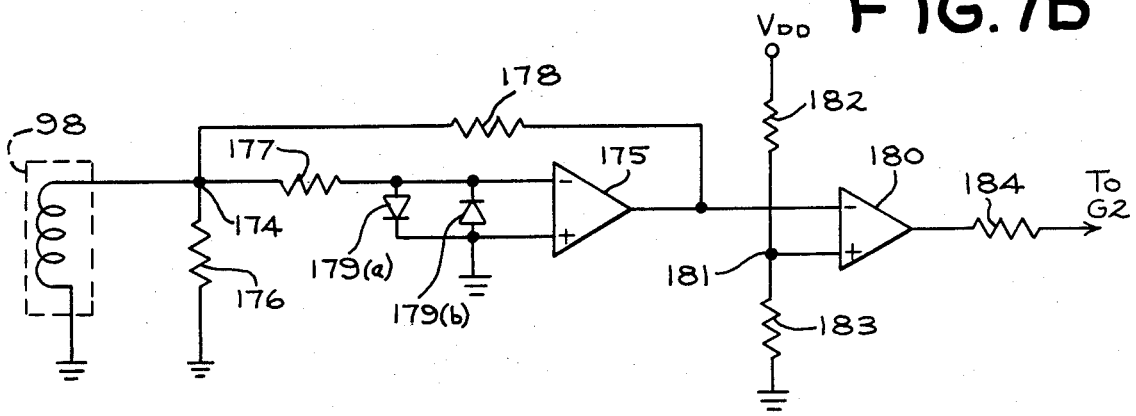
Figure 7C:
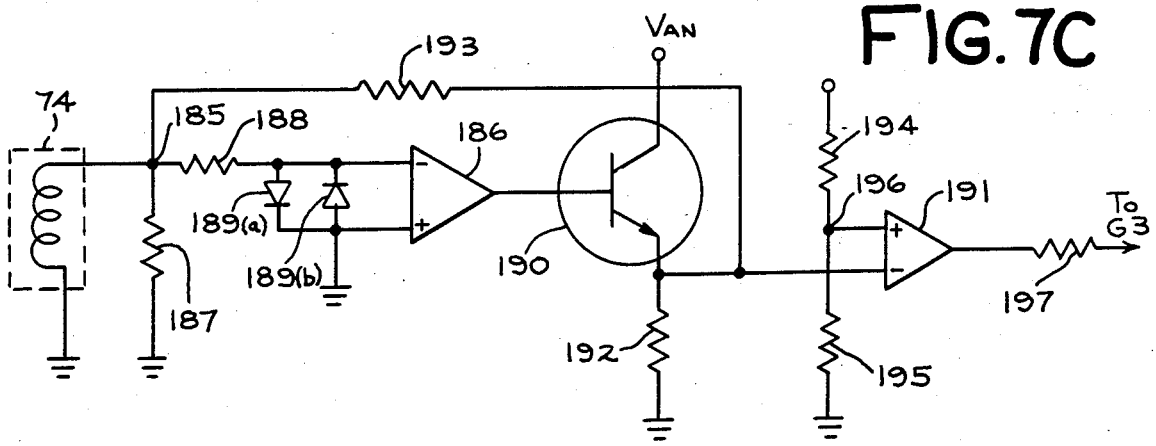

Referring now to FIGS. 7A–7C, the sensing circuits 104, 106 and 108 will be described in greater detail beginning with temperature sensing circuit 104 (FIG. 7A). Temperature sensing circuit 104 includes sensor means comprising a negative temperature coefficient thermistor 150 connected in a voltage divider bridge network comprising fixed resistors 151, 152, 153 and 154. Regulated DC voltage signal $V_{DD}$ biases the bridge network. A first voltage comparator 155 compares the voltage across thermistor 150 to a first reference voltage representative of a first reference temperature. A second voltage comparator 160 compares the voltage across thermistor 150 to a second reference temperature.

Considering first comparator 155, junction 156 between thermistor 150 and resistor 151 is connected to its inverting input. Junction 157 between resistors 152 and 153 is connected to its non-inverting input. Feedback resistor 158 is connected between the comparator output and its non-inverting input. A pulse train, synchronized with the signal at $S_1$, is applied at terminal $S_1'$ and coupled to the output of comparator 155 via pull-up resistor 159. The voltage at the junction 156 represents the sensed temperature in freezer compartment 18 (FIG. 1). Resistors 152, 153 and 154 are selected such that the voltage at junction 157 represents a first threshold temperature, which is preferably on the order of 35° F. The output of comparator 155 is pulled up to the voltage at $S_1'$ voltage at junction 156 is less than the voltage at 157, signifying a sensed freezer temperature greater than 35° F. and is at system ground corresponding to a logic zero level when the voltage at junction 156 is greater than the voltage at junction 157, signifying a sensed freezer temperature less than 35° F.

Similarly, junction 156 is connected to the inverting input of comparator 160. Junction 161 between resistors 153 and 154 is connected to the non-inverting input of comparator 160. Feedback resistor 162 is connected between the output of comparator 160 and its non-inverting input. A pulse train applied at $S_2'$, which is synchronized with the voltage at $S_2$, is coupled to the output of comparator 160 via pull-up resistor 163. Resistors 152, 153 and 154 are also selected such that the voltage at junction 161 represents a second predetermined threshold temperature higher than the first reference temperature. Preferably this second reference temperature is on the order of 55° F. When the voltage at junction 156 is greater than that at 161, signifying a sensed freezer temperature less than 55° F., the output of comparator 160 is at system ground corresponding to a logic zero level. When the voltage at junction 156 is less than that at 161, signifying a sensed freezer temperature greater than 55° F., the output of comparator 160 is pulled up to $S_2'$. The outputs of comparators 155 and 160 are coupled in wired OR fashion at 164 via diodes 165 and 166 respectively. Junction 164 is coupled to microprocessor input port G1 (FIG. 4) and to system ground via resistor 167.

It will be recalled that freezer temperature sensor circuit 104 is to detect three temperature conditions: sensed freezer temperature less than 35° F.; sensed freezer temperature greater than 35° F. but less than 55° F.; and sensed freezer temperature greater than 55° F. These three conditions are signified using a single two-state output line by alternately enabling comparators 155 and 160 and programming microprocessor 102 to properly process the input signal received at G1. Comparators 155 and 160 are effectively enabled by the pulse trains applied at $S_1'$ and $S_2'$ respectively.

Figure 5B:
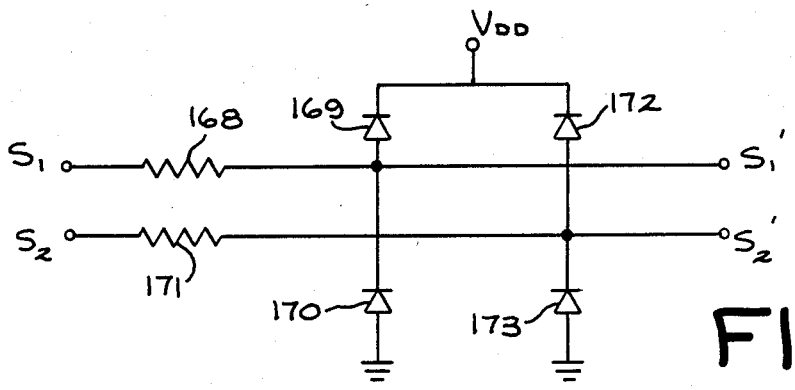

The circuitry for generating the pulse trains at $S_1'$ and $S_2'$ is illustrated in FIG. 5B. $S_1'$ is connected to $S_1$ via voltage dropping resistor 168. Clamping diodes 169 and 170 clamp the voltage at $S_1'$ to one diode drop greater (0.6 volts) than regulated positive dc voltage $V_{DD}$ and one diode drop less than system ground respectively. Similarly, $S_2'$ is connected to $S_2$ via resistor 171 and clamped to $V_{DD}$ and ground by diodes 172 and 173 respectively. $V_{DD}$ is derived from $V_{AN}$ by conventional voltage regulator circuitry not shown. The resultant waveforms are shown in FIG. 6. Waveforms C and D represent the voltage at $S_1'$ with respect to ground and $S_2'$ with respect to ground respectively.

It is apparent from waveforms C and D (FIG. 6) that the voltages at $S_1'$ and $S_2'$ are positive with respect to ground during opposite half-cycles of the 60 Hz power signal. As will be hereinafter described, microprocessor 102 is programmed to store the inputs received at the G input ports when $S_1$ and $S_1'$ are positive in a Phase 1 input register and inputs received when $S_2$ and $S_2'$ are positive at a Phase 2 input register, and to decode the G1 bit in the Phase 1 and Phase 2 input registers as follows. A logic zero at G1 when $S_1'$ is zero and when $S_2'$ is zero signifies a sensed freezer temperature less than 35° F.; a logic one at G1 when $S_1'$ is high and a logic zero when $S_2'$ is high signifies a sensed temperature greater than 35° F. and less than 55° F.; and a logic one at G1 when $S_2'$ is high signifies a sensed freezer temperature greater than 55° F.

The icemaker current sensing circuit 106 (FIG. 4) is shown in simplified schematic form in FIG. 7B. Current transformer winding 98 as hereinbefore described with reference to FIG. 3, senses the current flowing in the icemaker motor and mold heater circuit. One terminal of winding 98 is connected to ground. The other designated 174 is connected to the inverting input of op amp 175 via stabilizing resistor 176 and current limiting resistor 177. Resistor 176 is connected between winding terminal 174 and ground to provide a low resistance path for any noise and transients when winding 98 is not drawing current. Resistor 177 couples winding terminal 174 to the inverting input of op amp 175. Feedback resistor 178 couples the output of op amp 175 to terminal 174. Oppositely poled diodes 179(*a*) and 179(*b*) are coupled between the inverting input of op amp 175 and its grounded non-inverting input to minimize noise and transients effects. By this arrangement the output voltage for op amp 175 is proportional to the current sensed by winding 98.

The output of op amp 175 is coupled to the inverting input of comparator 180. The non-inverting input of comparator 180 is connected to the junction 181 between resistors 182 and 183, which are serially connected between dc supply $V_{DD}$ and ground, to provide a reference voltage at the non-inverting input. The output of comparator 180 is coupled to input port G2 of microprocessor 102 via current limiting resistor 184. The circuit parameters are selected such that when no current is flowing in the icemaker circuit, the voltage at the inverting input of comparator 180 is less than the reference resulting in a logic high signal being applied to G2. Normal operating current in the icemaker circuitry causes the voltage at the inverting input of comparator to exceed the reference voltage internally grounding the output of the comparator resulting in a logic low or zero signal being applied to G2. As will be hereinafter described, microprocessor 102 is programmed to recognize a logic zero input at G2 as signifying that the icemaker circuitry is energized, and a logic one signal as signifying that it is de-energized.

The defrost current sensor circuit 108, shown schematically in FIG. 7C, is very similar to icemaker current sensor circuit 106. As hereinbefore described with reference to FIG. 4, current transformer winding 74 senses current flowing in defrost heater 48. One terminal of winding 74 is connected to ground; the other designated 185 is connected to the inverting input of op amp 186 via stabilizing resistor 187 and current limiting resistor 188. Resistor 187 is connected between winding terminal 185 and ground to provide a low resistance path for noise and transients when winding 74 is not drawing current. Resistor 188 couples winding terminal 185 to the inverting input. Oppositely poled diodes 189(*a*) and 189(*b*) are connected beween the inverting input and the grounded non-inverting input to minimize noise and transient effects. At this point, the circuit of FIG. 7C differs slightly from FIG. 7B, due to the substantially greater current drawn by the defrost heater relative to that drawn by the icemaker circuit. The defrost heater current during defrost cycles causes the secondary current required by current transformer winding 74 to exceed the current capability of op amp 186. Driver transistor 190 is coupled in emitter follower configuration between the output of op amp 186 and the inverting input of comparator 191 to provide the additional current gain required. Specifically, the output of op amp 186 is coupled to the base of transistor 190. Supply voltage VAN is connected to the collector and resistor 192 couples the emitter to ground. The emitter is also connected to the inverting input of comparator 191 and to junction 185 via feedback resistor 193. A voltage divider comprising serially connected resistors 194 and 195 coupled between $V_{DD}$ and ground provide a reference voltage at junction 196 which is connected to non-inverting input of comparator 191. The output of comparator 191 is coupled to G3 of microprocessor 102 by current limiting resistor 197.

By this arrangement the voltage at the inverting input of comparator 191 is proportional to the sensed defrost heater current. When the heater is de-energized, the voltage at the inverting input of comparator 191 is less than the reference voltage at the non-inverting input resulting in a logic high signal being applied to input port G3. When the defrost heater is energized, the current induced in winding 74 is sufficient to raise the voltage at the inverting input of comparator 191 above the reference voltage, grounding the comparator output resulting in a logic low signal being applied to input port G3. As will be hereinafter described, microprocessor 102 is programmed to recognize a logic zero at input port G3 as signifying that the defrost heater is energized and a logic one as signifying that the defrost heater is de-energized.

The following components and component values are believed suitable for use in the sensor and display circuit of FIGS. 4, 5A, 5B,and 7A–7C.

TABLE I

| | | | |
|---|---|---|---|
| Microprocessor | | Fixed Resistors - | |
| 102 COPS 420L (National Semiconductor) | | 176, 187 | 10 |
| | | 193 | 75 |
| Integrated Circuits | | 139 | 220 |
| 155, 160 | LM 339 | 178 | 390 |
| 175, 186 | LM 2902 | 177, 188 | 1 K |
| 180, 191 | | 153 | 3.09 K |
| 138 | ULN 2004 A | 146, 152, 154, 159, 163, 168, 171, 184, 192, | 10 K |
| LEDs | | 197 | |
| Arrays 112, 114 | TLG 321 (Toshiba) | 167 | 15 K |
| Arrays 128, 130 | TLG 251 (Toshiba) | 183, 195 | 27 K |
| 38 | SLR-34 (Rohm) | 182, 194 | 36 K |
| | | 151 | 113 K |
| Diodes | | 128 | 100 K |
| 120, 126 | 1N4002 | | |
| 135 (a)–135 (d) | | | |
| 179 (a), 179 (b), | | 158, 162 | 1 M |
| 189 (a), 189 (b), | 1N914 | | |
| 169, 170, 172, 173 | | Current Transformer Ratio | |
| 165, 166 | | 74, 98 | 200 to 1 Stepdown |
| Capacitors | | | |
| 14,130 | .01 uf | | |
| 134 | .1 uf | | |
| 136 | 4700 uf | Voltage Supplies | |
| | | $S_1$,N | 14 volts (Peak) |
| | | $S_2$,N | half-wave rectified ac sine wave |
| | | $V_{DD}$ | 5.6 volts (dc) |
| | | $V_{AN}$ | 12 volts (dc) |

CONTROL PROGRAM

Microprocessor 102 is customized to control the sensor and display system by permanently configuring the Read Only Memory (ROM) of microprocessor 102 to implement predetermined control program instructions.

The primary function of microprocessor 102 relevant to the present invention is to monitor the output from the freezer temperature sensor circuit and provide the appropriate display signals upon detection of certain abnormal temperature conditions in the freezer compartment. For the sake of simplicity and brevity the description of the control program implemented by microprocessor 102 will be described on an essentially functional basis. It should be understood that the control program may include in addition to the control and diagnostic routines described herein, other routines to implement additional functions including monitoring functions such as monitoring the state of the refrigerator/freezer doors to alert the user if a door is left open.

The flow diagrams of FIGS. 8–16 illustrate the control program utilized to control the sensor and display system for refrigerator of FIG. 1. From these diagrams one of ordinary skill in the programming art could prepare a set of instructions for permanent storage in the Read Only Memory of microprocessor 102 to implement the control routine. It will be appreciated that instructions for carrying out the routine described in the flow diagrams of these figures may be interleaved with instructions and routines for other control features and functions as well.

It will be recalled from the description of the sensor and display circuitry of FIGS. 4–6 that the microprocessor inputs and outputs are multiplexed in synchronization with the 60 Hz power line signal. In the discussion to follow, operations conducted during positive half-cycles are referred to as Phase 1 operations and operations conducted during negative half-cycles are referred to as Phase 2 operations. To facilitate the multiplexing of the input and output signals, the Random Access Memory (RAM) of microprocessor 102 includes 2 four-bit G-input registers and 2 eight-bit L-output registers. One input register stores inputs received at ports G0–G3 during Phase 1 and the other stores inputs received at these ports during Phase 2. (Input port G0 is not used in this embodiment; however it could be used to monitor other operating conditions such as the state of the compartment doors if desired.) One output register stores the Phase 1 output display code and the other stores the Phase 2 output display code. The Phase 1 output display code is the code output to ports $L_0$–$L_7$ during Phase 1. Similarly, the Phase 2 output code is the code that is output to ports $L_0$–$L_7$ during Phase 2. It will be recalled that ports $L_0$–$L_7$ control the left-hand digit of display 32 and the normal display 34 (FIG. 2) which are enabled during Phase 1; and the right-hand digit of display 32, normal display 34 and Warm Temperature Indicator LED 36 which are enabled during Phase 2.

The control program is executed once each half-cycle of the 60 Hz power signal with each pass through the program beginning upon detection of a zero crossing of the power signal. The function of the control program is to read in the data received at input ports G1–G3 and $I_0$, to process these inputs to determine if one or more fault conditions exist, and to provide the appropriate output display, that is, either the normal signal or the appropriate fault code alerting the user to the existence of a particular fault condition. The particular fault conditions detected by the sensor and display system include undesirable over-temperature condition in the freezer which, depending upon the particular nature of the fault, is signified by energizing the Warm Temperature LED or displaying the diagnostic code FF or both; a malfunction of the defrost heater signified by the diagnostic code DE; and a malfunction of the automatic icemaker signified by the fault diagnostic code CI.

Numerous flags and timers are utilized in the control program. Input flags which are set in response to input signals received at G1–G3 and $I_0$ include a 35° flag and a 55° flag, which are set in response to detection of freezer temperatures greater than 35° F. and 55° F. respectively; an IM ON flag set in response to detection of current in the icemaker circuit; a DE ON flag set in response to detection of current in the defrost heater; and a Key flag set in response to user actuation of the reset key 36 (FIGS. 2 and 4). Fault flags are set when timing information relating to how long or how frequently the input flags are set signifies a particular fault condition. The fault flags include a Warm Temperature flag which is set when the 35° flag remains set for 4 hours or the 55° flag remains set for 1 hour; an FF fault flag which is set when the 35° flag remains set continuously for 6 hours or the 55° flag remains set continuously for 2 hours; an IM fault flag which is set when the IM ON flag remains set continuously for 5 hours or the time between successive settings of the IM flag is less than 10 minutes for 3 consecutive times; and a DE fault flag which is set whenever the time between successive settings of the DE ON flag is greater than 48 hours.

The output display registers are encoded in accordance with the state of the fault flags. When more than one fault flag is set, a prioritizing routine establishes the relative priorities with the highest priority fault being displayed. When displaying one of the FF, IC and DE fault codes, display 32 is blinked on and off at ½ second intervals to provide a flashing display. When the Warm Temp flag is set, the Warm Temperature indicator is continuously illuminated. When no abnormal conditions are detected the normal indicia is illuminated.

Figure 8:
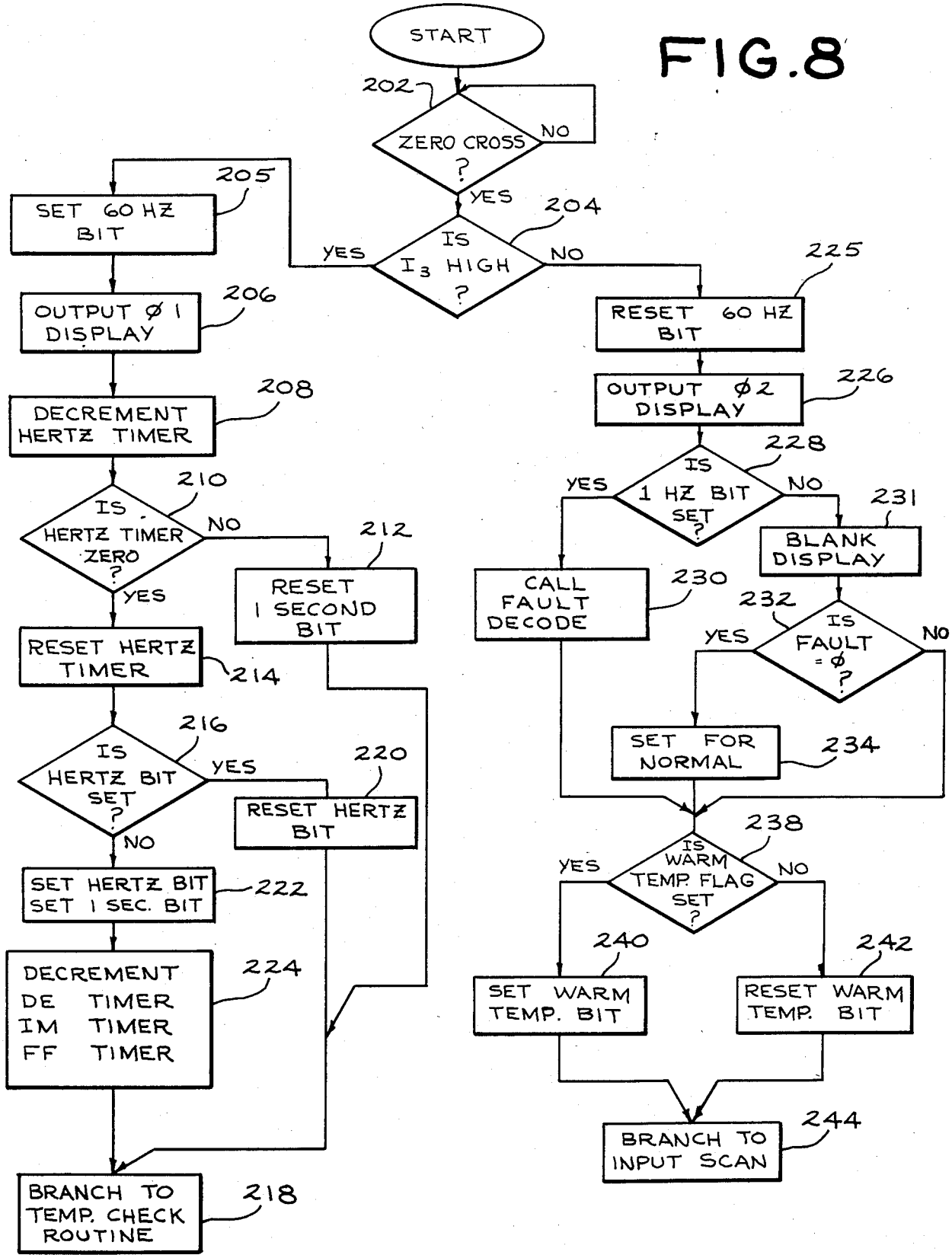
FIG. 8 is a flow diagram of the Start routine incorporated in the control program for the microprocessor in the circuit of FIG. 4.

Referring now to the flow charts of FIGS. 8–16 for the various routines, the control program will be described in greater detail beginning with the Start routine of FIG. 8. The function of this routine is to output the appropriate one of the Phase 1 and Phase 2 output display registers; to decrement the various timers utilized in other routines in the program; to reset as appropriate certain timing bits which are used for display timing purposes; and to update the output display registers.

Upon entering this routine, Inquiry 202 delays the program until the next zero crossing of the 60 Hz power signal is signified by a change in the state of the signal applied to input port $I_3$ from zero crossing detector circuit 140 (FIG. 4). Upon the detection of the zero crossing, Inquiry 204 determines whether the ensuing half-cycle is positive, Phase 1, or negative, Phase 2, by examining the input state at input port $I_3$. If $I_3$ is high, a bit designated the 60 Hz bit is set (Block 205) to indicate Phase 1 operation, and the data stored in the Phase 1 output storage register are output to the output ports $L_0$–$L_7$ (Block 206). Next a timer designated the Hertz timer is decremented (Block 208). The Hertz timer is a ½ second timer, which is initialized to 29. It is decremented at Block 208 every other half-cycle of the 60 Hz power signal. Hence, it is decremented to zero once every ½ second. Inquiry 210 checks the state of the Hertz timer to see if it has timed out. If not, a bit designated the one-second bit is reset (Block 212).

If the Hertz timer has timed out, then the timer is reset to 29 at Block 214. Next, a bit designated the One Hertz bit is checked by Inquiry 216. The One Hertz bit which toggles every half second is used to flash the diagnostic code display at ½ second intervals as will be described hereinafter. If this bit is set, it is reset (Block 220); if reset, it and the one second bit are set at Block 222 and several timers utilized in other routines yet to be described designated, the DE timer, the IM timer and the FF timer are decremented one count (Block 224). Since the Hertz timer times out at one-half second intervals, Blocks 222 and 224 are effective to set the Hertz bit and the one second bit at the beginning of each second, that is during the first positive line cycle of each one second interval and the various timers are decremented at a one second rate.

Figure 14:
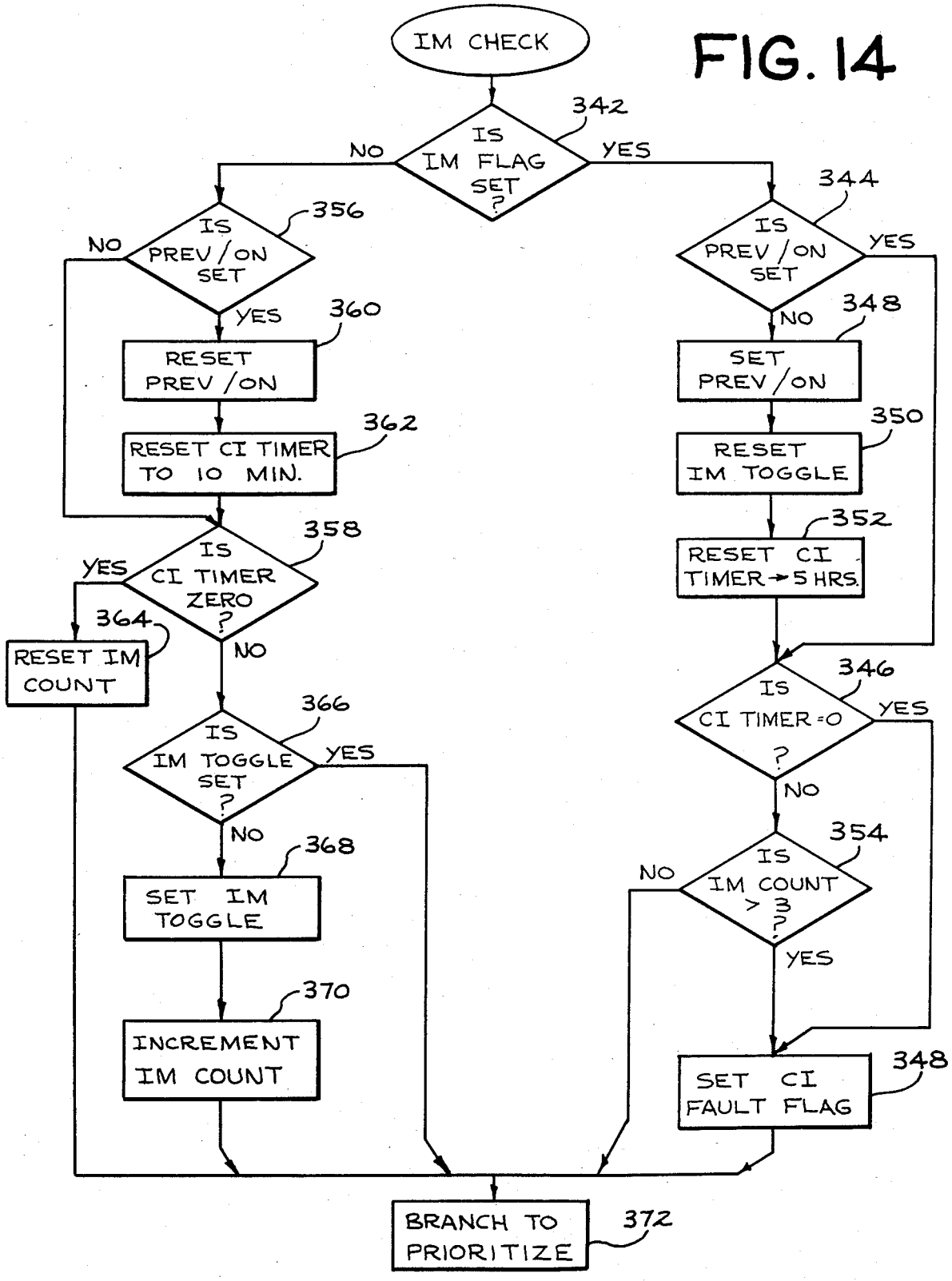
FIG. 14 is a flow diagram of the IM Check routine incorporated in the control program for the microprocessor in the circuit of FIG. 4.

Referring back to Inquiry 204, if the ensuing line cycle is a negative half-cycle signifying Phase 2 operation, the 60 Hz bit is reset signifying Phase 2 operation (Block 225). The data stored in output register for Phase 2 are output to output ports $L_0$–$L_7$ (Block 226) and Inquiry 228 checks the one Hertz bit. If the one Hertz bit is set, the Fault Decode sub-routine to be hereinafter described is called (Block 230). This sub-routine updates the Phase 1 and Phase 2 output registers. If the one Hertz bit is not set, the Phase 1 and Phase 2 output storage registers are encoded to blank the display during the next pass through the control routine (Block 231), and Inquiry 232 determines whether any fault condition has been detected during the previous pass through the routine. A variable designated Fault identifies the highest priority fault detected. If Fault equals 0, signifying no faults have been detected, then the output registers are encoded to energize the Normal display (Block 234). If Fault is not 0, the program proceeds to Inquiry 238. Since the one Hertz bit toggles at a ½ second rate, by this arrangement in the event a fault code is being displayed, Block 230 and Block 231 will be entered at alternate ½ second intervals, resulting in a flashing display which flashes at a ½ second rate. Inquiry 238 checks the state of the Warm Temp flag. If set, the Warm LED bit in the Phase 1 output register is set (Block 240). If the Warm Temp flag is not set, the Warm LED bit in the output register is reset (Block 242). The program then branches (Block 244) to the input scan routine (FIG. 14).

Figure 9:
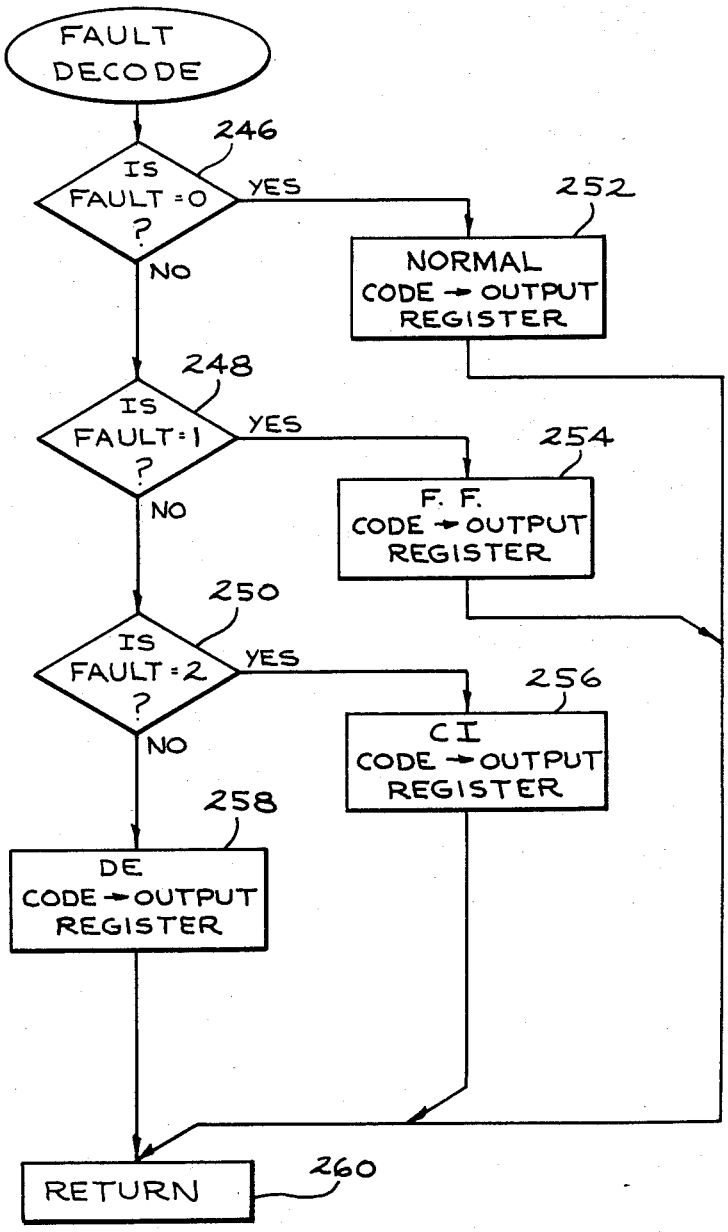
FIG. 9 is a flow diagram of the Fault Decode subroutine incorporated in the control program of the microprocessor in the circuit of FIG. 4.

The flow diagram for the Fault Decode sub-routine called at Block 230 (FIG. 8) is shown in FIG. 9. The function of this routine is to load the appropriate fault code in the output registers. The Fault variable is assigned a value in the Prioritizing routine (FIG. 12) hereinafter described, representing the highest priority fault detected. Values 0, 1, 2 and 3 represent the Normal condition, the frozen food fault condition FF, the ice-maker fault condition CI, and the defrost fault condition DE respectively. Inquiries 246, 248 and 250 determine the value of the Fault variable and loads the appropriate output code into the output registers (Blocks 252, 254, 256, and 258). The program then returns (Block 260) to the Start routine at Block 230 (FIG. 8).

Figure 10:
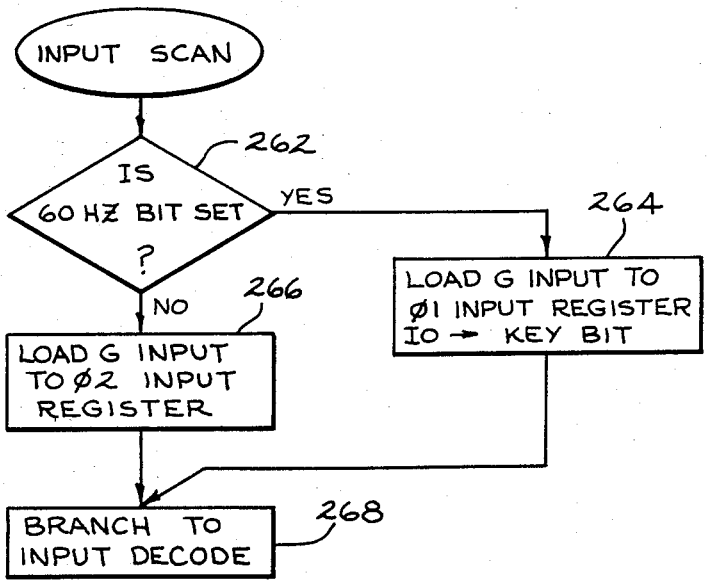
FIG. 10 is a flow diagram of the Input Scan routine incorporated in the control program of the microprocessor in the circuit of FIG. 4.
Figure 11:
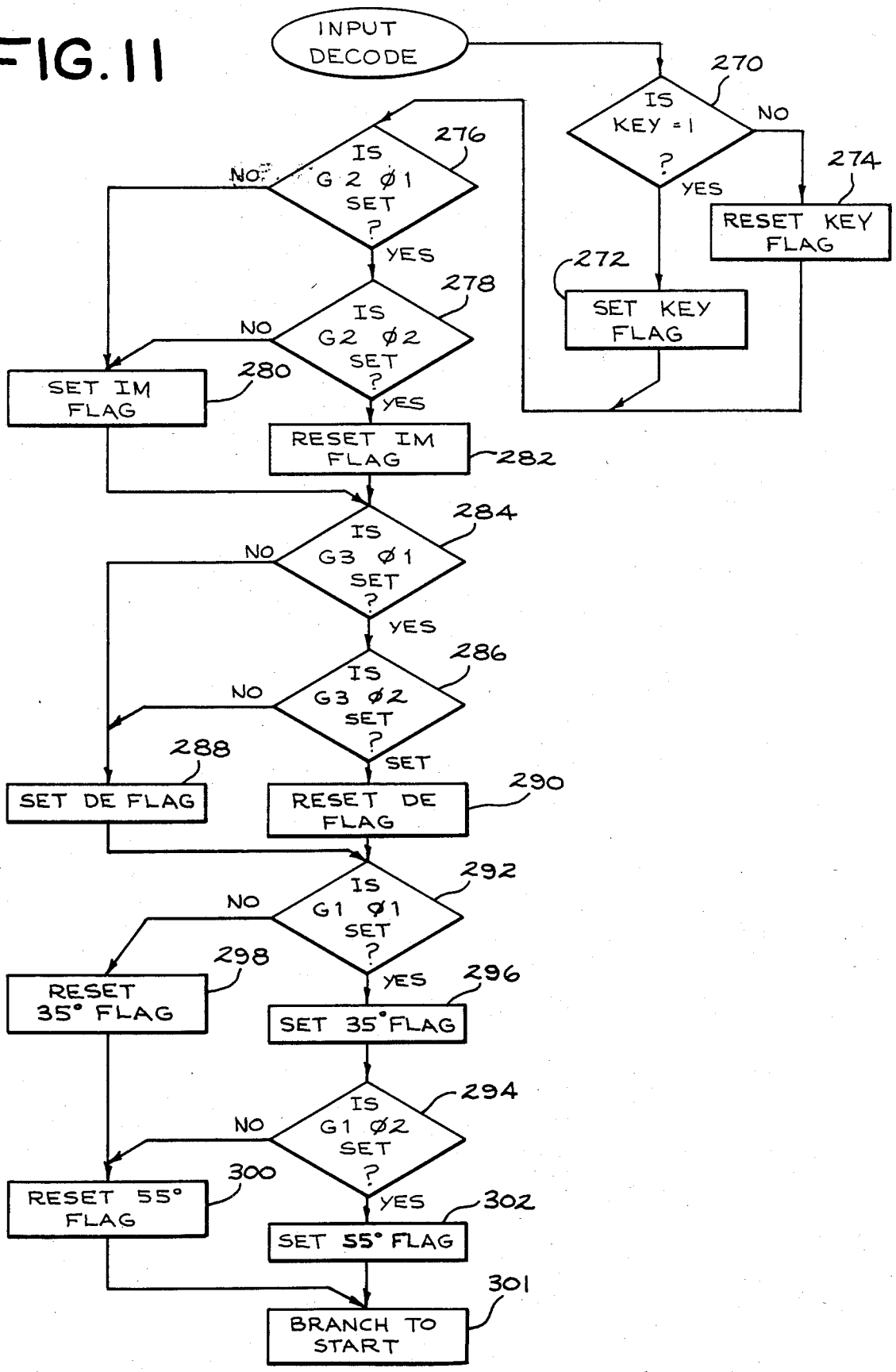
FIG. 11 is a flow diagram of the Input Decode routine incorporated in the control program of the microprocessor in the circuit of FIG. 4.

Referring next to FIG. 10, there is shown the flow diagram for the Input Scan routine which is entered from the Start routine (FIG. 8) when operating in Phase 2 and from the Reset Key routine to be hereinafter described (FIG. 15) when operating in Phase 1. The function of this routine is to transfer the data received at input ports G1, G2, G3 and $I_0$ to the appropriate Phase 1 or Phase 2 input register. Upon entering this routine Inquiry 262 determines if the 60 Hz bit is set signifying Phase 1 operation or reset signifying Phase 2 operation. If set, the data at the G input ports are stored in the Phase 1 input register and the input at $I_0$ updates the Key bit (Block 264). If the 60 Hz bit is reset, the G port inputs are loaded in the Phase 2 input register (Block 266). The program then branches (Block 268) to the Input Decode routine (FIG. 11).

The function of the Input Decode routine is to decode the Phase 1 and Phase 2 input registers and Key bit and set or reset the Key, IM, DE and 35° and 55° flags accordingly. Inquiry 270 checks the state of the Key bit and sets or resets the key flag accordingly (Blocks 272 and 274). The key flag signifies whether the reset key has been actuated. Inquiries 276 and 278 check the appropriate bit in the Phase 1 and Phase 2 input registers respectively to determine if the input at G2 was high or low. If either the Phase 1 or the Phase 2 bit is low, signifying the detection of current flowing to the ice-maker circuit, the IM flag is set (Block 280). If both bits are high, the IM flag is reset (Block 282). Inquiries 284 and 286 check the state of the bit in the Phase 1 and Phase 2 input registers respectively representing the input received at G3. If either bit is low, signifying detection of current flow in the defrost heater circuit, the DE flag is set (Block 288). Otherwise, the DE flag is reset (Block 290). Inquiries 292 and 294 check the bits in the Phase 1 and Phase 2 input registers respectively, representing the inputs received at G1. It will be recalled that a logic one input at G1 during Phase 1 signifies a sensed freezer temperature greater than the 35° reference temperature. Hence, if the Phase 1 bit is set, the 35° flag is set (Block 296). If the Phase 1 bit is reset signifying a sensed temperature less than 35° F., the 35° flag is reset (Block 298), and the 55° flag is reset (Block 300) and the program returns (Block 301) to the Start routine (FIG. 8). If the Phase 1 temperature bit is set, Inquiry 296 checks the Phase 2 bit. It will be recalled that if the input at G1 is high during Phase 2, this indicates a sensed freezer temperature greater than the 55° F. reference. Hence, if the Phase 2 temperature bit is set, the 55° flag is set (Block 302). Otherwise, the 55° flag is reset (Block 300) and the program returns (Block 301) to the Start routine (FIG. 8) to await the start of the next pass through the control program.

Figure 12:
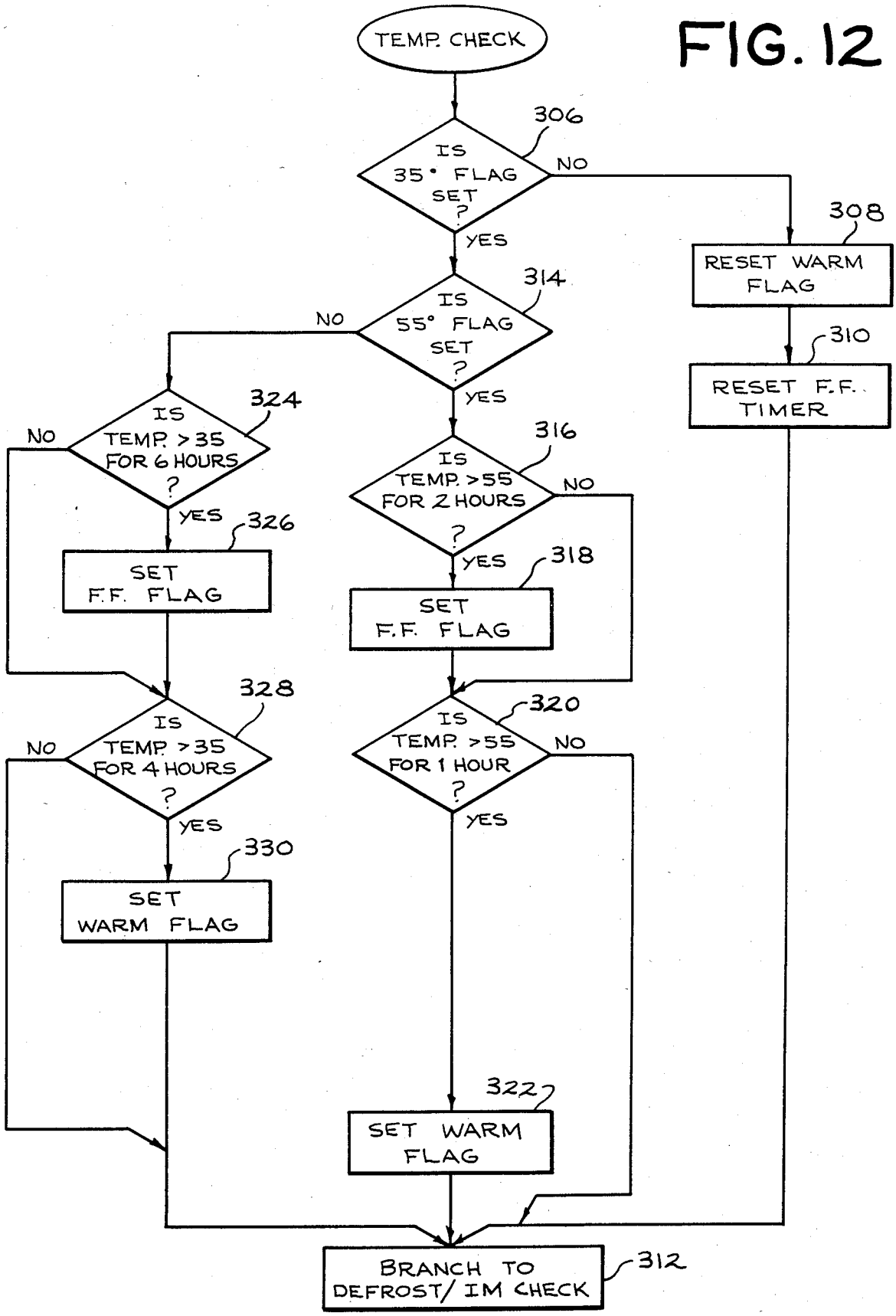
FIG. 12 is a flow diagram of the Temp Check routine incorporated in the control program of the microprocessor in the circuit of FIG. 4.

The flow diagram for the Temp Check routine is shown in FIG. 12. The function of this routine, which is entered from the Start routine during Phase 1 operations, is to monitor the duration of any sensed over-temperature condition and set the appropriate Warm or Frozen Food fault flags as appropriate in accordance with the present invention. More specifically, the Warm flag will be set to ultimately energize the Warm Indicator light when the sensed freezer temperature exceeds the 35° F. reference temperature for more than 4 hours or the 55° F. reference temperature for more than 1 hour. The Warm flag, once set, remains set until the sensed temperature drops below 35° F.

Additionally, the FF fault flag is set to ultimately display the FF diagnostic code if the sensed temperature exceeds 35° F. for 6 hours or 55° F. for 2 hours. The FF flag, once set, remains set until reset by user actuation of the Reset Key 36 (FIG. 2).

Figure 13:
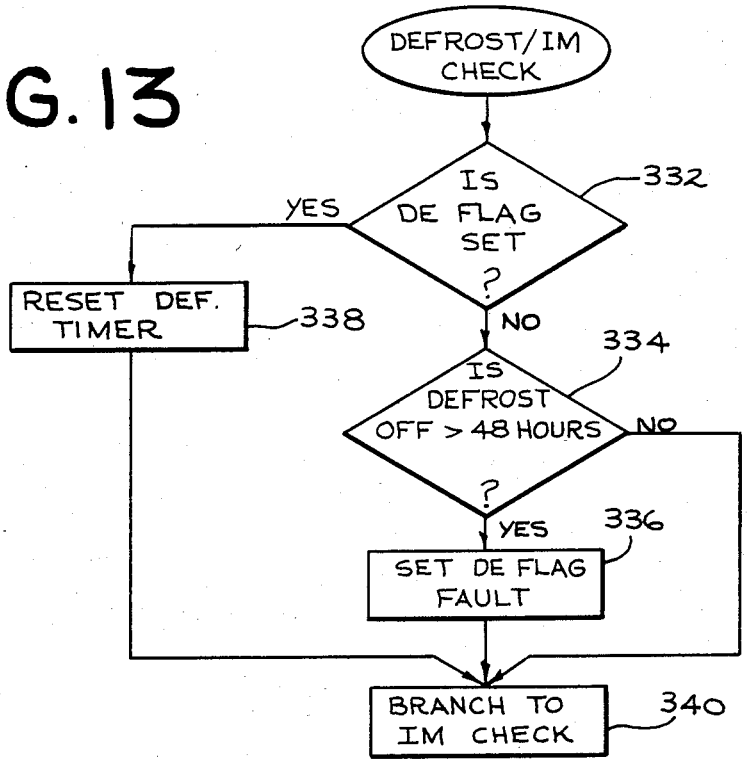
FIG. 13 is a flow diagram of the Defrost Check routine incorporated in the control program of the microprocessor in the circuit of FIG. 4.

On entering the routine, Inquiry 306 checks the 35° flag. If not set, the Warm flag is reset (Block 308), the Frozen Food timer is reset (Block 310), and the program branches (Block 312) to the Defrost Check routine (FIG. 13). If the 35° flag is set signifying a sensed temperature greater than the 35° F. reference temperature, Inquiry 314 determines whether the 55° flag is set signifying a Frozen Food temperature greater than the 55° F. reference temperature. If set, Inquiry 316 checks the Frozen Food timer to determine if the flag has been set for a time period greater than 2 hours. If yes, the FF fault flag is set (Block 318). Otherwise, the program simply proceeds to Inquiry 320 which determines if the FF flag has been set for a one hour period. If not, the program branches (Block 312) to the Defrost Check routine (FIG. 13). If the flag has been set for more than one hour, the Warm flag is set (Block 322) and the program branches (Block 312) to the Defrost Check routine. Referring back to Inquiry 314, if the 55° flag is not set signifying a temperature greater than 35° and less than 55°, Inquiry 324 determines if the 35° flag has been set for greater than six continuous hours. If so, the FF fault flag is set (Block 326). The program then proceeds to Inquiry 328 which determines if the 35° flag has been set for continuous period of more than four hours. If yes, the Warm flag is set (Block 330). The program then proceeds (Block 312) to the Defrost Check routine (FIG. 13).

The function of the Defrost Check routine is to monitor the duration of time between defrost cycles by monitoring the time between defrost current "on" signals to detect a defrost circuit malfunction. Referring now to the flow diagram of FIG. 13, Inquiry 332 checks the state of the DE flag. It will be recalled that the DE flag is set or reset in the Input Decode routine (FIG. 11) depending upon whether or not current flow is sensed in the defrost circuit. If reset, signifying that the defrost heater is not energized, Inquiry 334 checks the defrost timer to determine if the defrost heater has been off for a period greater than 48 hours. If the heater has been off for more than 48 hours, the DE fault flag is set (Block 336). Referring again to Inquiry 332, if the DE flag is set, signifying that the current is flowing in the defrost heater, the defrost timer is reset (Block 338). The program then branches (Block 340) to the IM Check routine (FIG. 14).

The function of the IM Check routine is to monitor the duration of continuous on time for the icemaker circuit to detect a blocked or stalled icemaker condition and to monitor the time between successive on periods of the icemaker circuit which if too short signifies a malfunction of the icemaker. Specifically, for purposes of the illustrative embodiment this routine determines if current is flowing in the icemaker circuit continuously for a time period greater than 5 hours, or if the time between successive icemaker on periods is less than 10 minutes on 3 consecutive occasions. Upon detection of either condition, the CI fault flag is set, signifying the existence of an icemaker fault condition.

Referring to the flow diagram in FIG. 14, Inquiry 342 checks the state of the IM flag. It will be recalled that the IM flag is set or reset in the Input Decode routine (FIG. 11) depending upon whether or not current is detected in the icemaker circuit. If set, signifying that the icemaker is on, Inquiry 344 checks a flag designated the Prev/on flag which if set indicates that during the previous pass through the control program the icemaker was on and which if reset signifies that during the previous pass through the control program the icemaker was off. If set, the program proceeds to Inquiry 346. If reset, signifying that the icemaker has just been turned on, the Prev/on flag is set (Block 348), and a flag designated the IM toggle flag is reset (Block 350). The toggle flag, which is set during icemaker on periods and reset during off periods, is used to identify the first pass through this routine during each on and off period. Next the icemaker timer is reset to 5 hours (Block 352). During icemaker on periods, the icemaker timer functions as an ON timer monitoring the duration of the "on" periods. Inquiry 346 checks the icemaker timer to see if the 5 hour time period has timed out. If so, the icemaker has been on for a period in excess of 5 hours and the CI fault flag (Block 348) is set. If the CI timer has not timed out, Inquiry 354 checks the state of a counter designated the IM Count counter which keeps track of how many successive attempts have been made to turn the icemaker on at less than 10 minute intervals as will be hereinafter described. If the IM count is greater than 3, the CI fault flag is set (Block 348).

Figure 15:
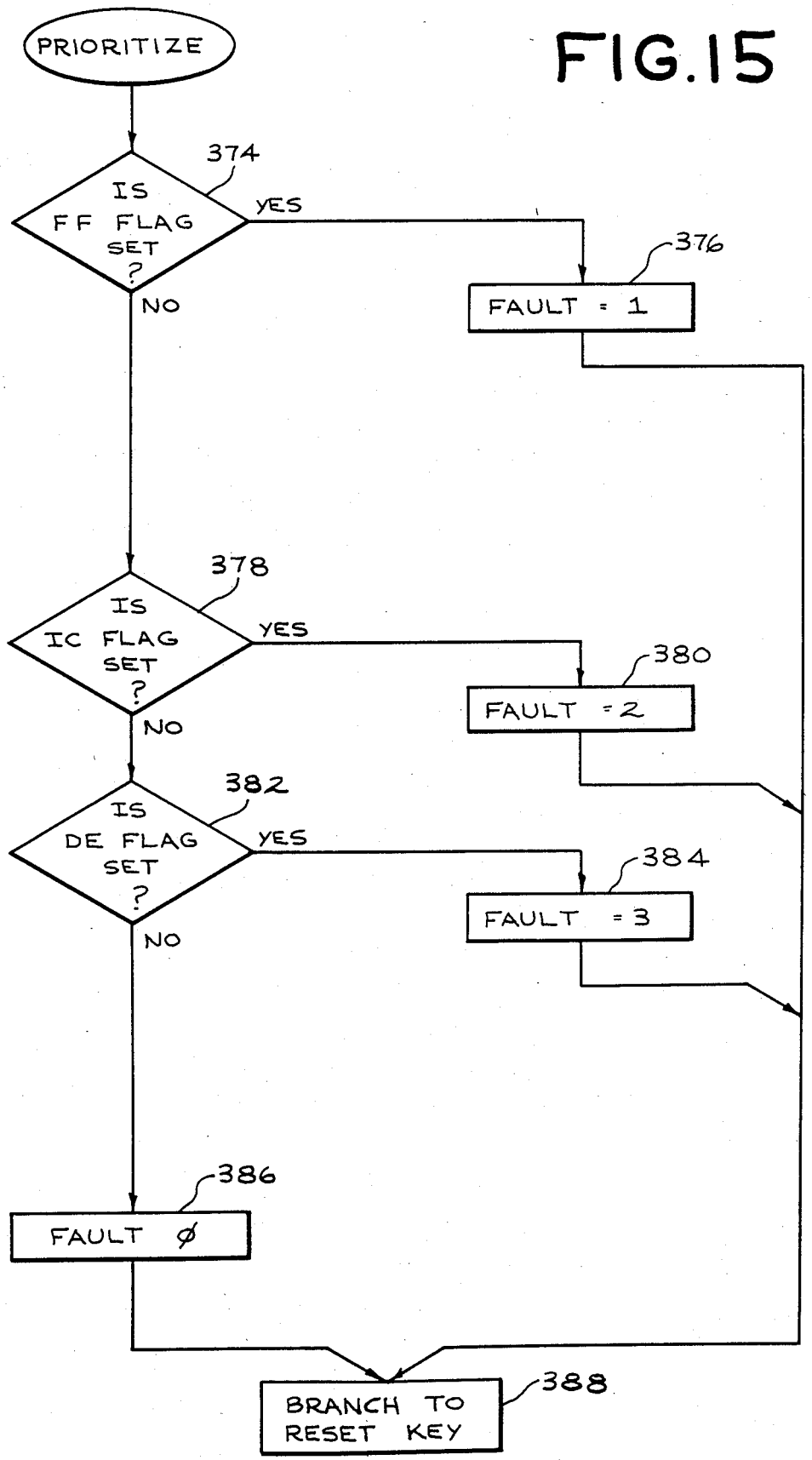
FIG. 15 is a flow diagram of the Prioritize routine incorporated in the control program of the microprocessor in the circuit of FIG. 4.

Referring back to Inquiry 342, if the IM flag is reset signifying that the icemaker is off, Inquiry 356 checks the Prev/on flag. If reset, signifying that the icemaker has been off, program proceeds to Inquiry 358. If set, signifying that the icemaker has just turned off, the prev/on flag is reset (Block 360) and the CI timer, which during icemaker off periods functions as an OFF timer, is set to 10 minutes (Block 362). Inquiry 358 checks to determine if the CI timer has been decremented down to 0, signifying an off time greater than 10 minutes. If yes, the IM counter is reset (Block 364). If not, Inquiry 366 checks the toggle flag. If reset, signifying the first pass through the IM Check routine since the icemaker was turned off, the IM toggle flag is set (Block 368) and the IM Count counter is incremented (Block 370). Since this portion of the routine is only entered during the first pass through this routine during each off period, the IM Counter is incremented once during each off period. Since the counter is only reset if the off period exceeds 10 minutes, the IM Counter counts successive attempts to start the icemaker following off times of less than 10 minutes. As previously described, Inquiry 354 and Block 348 set the CI fault flag if the IM Count exceeds 3. On completion of the routine the program then branches (Block 372) to the Prioritize routine (FIG. 15).

Figure 16:
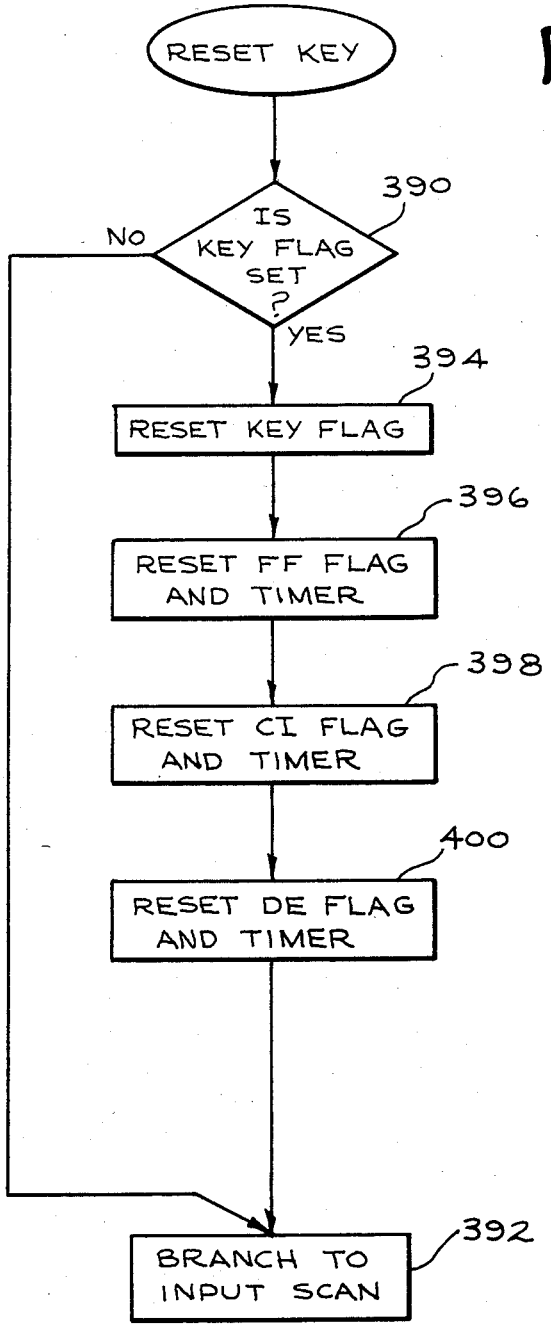
FIG. 16 is a flow diagram of the Reset Key routine incorporated in the control program of the microprocessor in the circuit of FIG. 4.

The function of the Prioritize routine is to assign priority values to the faults in the event that more than one fault has been detected. The descending order of priority as follows: frozen food fault, icemaker fault, and defrost fault. Only the highest priority fault will be displayed. Referring now to the flow diagram of FIG. 15, Inquiry 374 determines if the frozen food fault flag has been set. If so, the priority variable designated Fault is set equal to 1 (Block 376). If the frozen food flag is not set, Inquiry 378 checks the state of the IC icemaker fault flag. If set, Fault is set equal to 2 (Block 380). If not set, Inquiry 382 checks the state of the defrost fault flag. If set, Fault is set equal to 3 (Block 384). If not set, Fault is set equal to 0, signifying that none of the fault conditions have been detected (Block 386). The program then proceeds to the Reset Key routine (Block 388) (FIG. 16).

The function of the Reset Key routine is to reset the various fault flags and timers in response to user actuation of the reset key 36 (FIG. 2). It will be recalled that the FF, CI and DE fault flags, once set, are only to be reset by user actuation of the Reset Key to insure that the user is alerted that a fault condition was detected even if the condition no longer persists. Referring to the flow diagram of FIG. 16, Inquiry 390 determines if the Key flag is set. If not, the program branches (Block 392)

to the Input Scan routine (FIG. 10). If set, the Key flag is reset (Block 394). Blocks 396 and 400 reset the frozen food fault flag and timer, the icemaker fault flag and timer, and the defrost fault flag and timer respectively. The program then branches (Block 392) to the hereinbefore described Input Scan routine of FIG. 10.

From the foregoing it will be apparent that an improved over-temperature alarm system for refrigerator/freezer and freezer appliances is provided which provides a timely response to low as well as high over-temperature conditions while avoiding nuisance trips in response to normal temporary non-harmful over-temperature conditions.

While a specific embodiment of the invention has been illustrated and described herein, it is realized that numerous modifications and changes will occur to those skilled in the art. For example, in the illustrative embodiment visually discernible signals are displayed. It will be appreciated that audible signals could be employed in lieu of or in addition to the visual signals to alert the user to fault conditions. It is therefore to be understood that the appended claims are intended to cover all such modifications and changes which fall within the true spirit and scope of the invention.

What is claimed is:

1. An over-temperature alarm system for an appliance having a freezer compartment for storing perishable items, said alarm system comprising:

temperature sensing means for sensing the temperature in the freezer compartment;

means responsive to said temperature sensing means operative to detect a first temperature condition when the sensed temperature is greater than a first reference temperature, and to detect a second temperature condition when the sensed temperature is greater than a second reference temperature greater than said first reference temperature;

timer means for measuring the duration of said first and second temperature conditions;

signal generating means responsive to said timer means operative to generate a first user discernible warning signal whenever the duration of a first temperature condition exceeds a first relatively long delay time or the duration of a second temperature condition exceeds a second relatively short delay time less than said first delay time; said delay times being selected to be of sufficient duration to avoid warning signals in response to temporary over-temperature conditions likely to occur during normal operation;

whereby the user is alerted to the existence of an undesirable time/temperature condition in the freezer compartment.

2. The over-temperature alarm system of claim 1 wherein said signal generating means is further operative to generate a second user discernible warning signal when the duration of said first or second temperature conditions exceed third and fourth reference delay times respectively, said third and fourth reference delay times representing time periods of sufficient duration relative to the associated temperature conditions that perishable items stored in the freezer may have been adversely affected.

3. The over-temperature alarm system of claim 2 wherein said signal generating means is further operative to terminate said first warning signal and reset said timer means when said sensed temperature drops below said first reference temperature, and to continue said second warning signal, whereby the user is alerted that an undesirable temperature condition has continued for a sufficient time that items stored in the freezer may have been adversely affected regardless of whether the temperature subsequently returns to its normal operating range.

4. The over-temperature alarm system of claim 3 further comprising user actuable reset means and wherein said signal generating means is operative in response to actuation of said reset means to terminate said first and second signals and reset said timer means.

5. The over-temperature alarm system of claim 4 wherein said signal generating means comprises visual display means for providing the user discernible signal in the form of a visual signal.

6. A freezer over-temperature alarm system comprising:

freezer temperature sensing means;

first temperature comparing means responsive to said freezer temperature sensing means for detecting a freezer temperature in excess of a first predetermined threshold temperature; second temperature comparing means for detecting a freezer temperature in excess of a second predetermined threshold temperature higher than said first threshold temperature;

timer means responsive to said first and second comparing means operative to measure a first time period during which the freezer temperature is greater than said first threshold temperature and to measure a second time period during which the freezer temperature is greater than said second threshold tmperature;

means for comparing the duration of said first time period to a first predetermined delay time and comparing said second time period to a second predetermined delay time less than said first delay time, said first and second delay times being of sufficient duration to prevent response to temporary relatively short over-temperature conditions in the freezer compartment; and means for generating a first user discernible warning signal whenever said first time period exceeds said first delay time period or said second time period exceeds said second delay time signifying to the user that an undesirable time/temperature condition exists in the refrigerator freezer.

7. The freezer over-temperature alarm system of claim 6 further comprising:

means for comparing the duration of said first and second time periods to third and fourth predetermined delay times respectively, said third and fourth delay times being of sufficient duration that, if exceeded, perishable items stored in the freezer may be adversely affected; and means for generating a second user discernible warning signal upon detection of a first time period longer than a third reference time period or upon detection of a second time period longer than a fourth reference time signifying to the user that an undesirable temperature condition has existed in the freezer for sufficient time that perishable items stored therein may have been adversely affected regardless of whether the temperature subsequently returns to its normal operating range.

8. The over-temperature alarm system of claim 7 wherein said signal generating means is further operative to terminate said first warning signal and reset said timer means when said sensed temperature drops below said first reference temperature, and to continue said second warning signal, whereby the user is alerted that an undesirable temperature condition has continued for a sufficient time that items stored in the freezer may have been adversely affected regardless of whether the temperature subsequently returns to its normal operating range.

9. The over-temperature alarm system of claim 8 further comprising user actuable reset means and wherein said signal generating means is operative in response to actuation of said reset means to terminate said first and second signals and reset said timer means.

10. The over-temperature alarm system of claim 7 further comprising visual display means for providing said first and second user discernible signal in the form of a visual signals.

11. The over-temperature alarm system of claim 9 further comprising visual display means for providing said first and second user discernible signal in the form of a visual signals.

* * * * *